US005630534A

United States Patent [19]

Maier et al.

[11] Patent Number: 5,630,534

[45] Date of Patent: May 20, 1997

[54] MULTIPLE SOCK DONNING ASSIST DEVICE

[76] Inventors: Manfred Maier; H. Millicent MacCannell, both of c/o Samtex Inc., 205 E. Erie St., Blauvelt, N.Y. 10913

[21] Appl. No.: 600,089

[22] Filed: Feb. 12, 1996

[51] Int. Cl.[6] ..... A47G 25/90

[52] U.S. Cl. ..... 223/112; 223/111

[58] Field of Search ..... 223/111, 112, 223/120, 113, 118

[56] References Cited

U.S. PATENT DOCUMENTS

| | | | |
|---|---|---|---|
| D. 337,881 | 8/1993 | Peeler | D2/641 |
| 2,982,453 | 5/1961 | Zicarelli | 223/112 |
| 3,231,160 | 1/1966 | Glanville | 223/111 |
| 4,066,194 | 1/1978 | Leland | 223/111 |
| 4,260,083 | 4/1981 | Aslin | 223/111 |
| 4,284,216 | 8/1981 | Leland | 223/111 |
| 4,516,704 | 5/1985 | Hagman | 223/111 |
| 4,638,932 | 1/1987 | Keller | 223/111 |
| 4,765,520 | 8/1988 | Barton | 223/111 |
| 4,789,087 | 12/1988 | Doorenbos | 223/111 |
| 4,896,803 | 1/1990 | Wilkens | 223/112 |
| 4,942,988 | 7/1990 | Doorenbos | 223/111 |
| 5,082,154 | 1/1992 | French | 223/111 |
| 5,249,720 | 10/1993 | White | 223/112 |
| 5,303,856 | 4/1994 | Weatherholt, Sr. | 223/111 |
| 5,322,199 | 6/1994 | White | 223/111 |

*Primary Examiner*—Bibhu Mohanty
*Attorney, Agent, or Firm*—Richard L. Miller, P.E.

[57] ABSTRACT

A multiple leg covering donning assist device that includes a hollow horizontally-oriented and substantially opened-front base frame, a pair of hollow substantially vertically-oriented side frames, and a pair of hollow tandemly-positioned and substantially vertically-oriented intermediate frames. The hollow horizontally-oriented and substantially opened-front base frame has ends. The pair of hollow substantially vertically-oriented side frames are gripped by a user and extend vertically upwardly and slightly rearwardly from the ends of the hollow horizontally-oriented and substantially opened-front base frame and have a height. And, the pair of hollow tandemly-positioned and substantially vertically-oriented intermediate frames receive leg coverings and extend vertically upwardly and slightly rearwardly from the hollow horizontally-oriented and substantially opened-front base frame and are disposed intermediate the pair of hollow substantially vertically-oriented side frames, so that both legs of a user can be covered simultaneously.

16 Claims, 2 Drawing Sheets

MULTIPLE SOCK DONNING ASSIST DEVICE

BACKGROUND OF THE INVENTION

The present invention relates to a multiple sock donning assist device. More particularly, the present invention relates to a multiple sock donning assist device that is rigid and includes a three dimensional frame consisting of a plurality of elongated and slender cylindrical members for allowing multiple leg coverings to be donned simultaneously.

Many individuals with circulatory disorders are required to wear tight-fitting hosiery or stockings which are designed to support the legs and reduce the pooling of fluids in the legs and feet of the individual. Because of the strongly elastic nature of these stockings, many persons find it difficult to exert the force needed to apply the stockings over their feet and legs. In addition there are numerous individual who lack the flexibility to bend their legs or body to the degree needed to apply support stockings or even socks.

Various designs of devices for putting on stockings are known and devised to help disabled persons suffering from various handicaps in their ability to move.

There exist staff-shaped devices which are provided with hoop or sleeve-like members of varying shape and which usually are made of metal or other stiff material. These type of devices have a low friction coefficient and therefore a stocking easily slips off before it has reached the correct position.

There also exist devices which are made of soft material. These type of devices are not so common and the pull-on devices of this kind which now exist require great user mobility.

Numerous innovations for sock donning assist devices have been provided in the prior art that will be described. However, even though these innovations may be suitable for the specific individual purposes to which they address, they differ from the present invention in that they do not teach a multiple sock donning assist device that is rigid and includes a three dimensional frame consisting of a plurality of elongated and slender cylindrical members for allowing multiple leg coverings to be donned simultaneously.

FOR EXAMPLE, U.S. Pat. No. Des. 337,881 to Peeler teaches a stocking holder that includes a frame consisting of a plurality of elongated slender tubular members.

ANOTHER EXAMPLE, U.S. Pat. No. 4,066,194 to Leland teaches a sock donning device that includes a handle member from which laterally and transversely depend a pair of sock expanding and gripping members, and a combination frame positioner and sock release device.

STILL ANOTHER EXAMPLE, U.S. Pat. No. 4,260,083 to Aslin teaches a pull-on device for stockings that includes a stocking-foot resembling piece. The sole of the piece is stiff in the longitudinal direction and resilient at a middle portion. The middle portion is connected at the heel part with a rearward protruding plate member.

YET ANOTHER EXAMPLE, U.S. Pat. No. 4,284,216 to Leland teaches a sock donning assist device that includes a sock donning device that includes a handle member from which laterally and transversely depend a pair of sock expanding and holding members, and a control bar that extends between the wire-like handle members so as to adjust the space therebetween.

STILL YET ANOTHER EXAMPLE, U.S. Pat. No. 4,516,704 to Hagman teaches a hosiery donning aid that includes a rigid hoop and a handle. The handle is telescopic and pivotally secured to the inside of the hoop.

YET STILL ANOTHER EXAMPLE, U.S. Pat. No. 4,638,932 to Keller teaches a donning aid that includes a tong-like member having a pair of elongated arms extending from a handle end to a gripping end. The arms are integrally joined at the handle end in a U-bend and extend parallel in close side-by-side relationship to the gripping end. Resilient protective pads are provided at the gripping end of each arm.

STILL YET ANOTHER EXAMPLE, U.S. Pat. No. 4,789,087 to Doorenbos teaches a device for assisting in putting on elastic hosiery that includes an expandable tip consisting of a division in the portion over which the stocking is placed, means for biasing the two split parts to a normally closed position, and a latch to hold the device in an open position.

YET STILL ANOTHER EXAMPLE, U.S. Pat. No. 4,896,803 to Wilkens teaches an aid for putting on stockings that includes a frame-like construction with at least four substantially equidistantly spaced parallel-extending support rods having first ends and second ends. The first ends are interconnected by means of a first clip and the second ends are interconnected by means of a second clip.

STILL YET ANOTHER EXAMPLE, U.S. Pat. No. 4,942,988 to Doorenbos teaches a device to aid in putting on elastic hose that includes two looped ends to be inserted into the stocking. The loops are hinged together and movable between a closed position and a spread position. The hinge includes a slide.

YET STILL ANOTHER EXAMPLE, U.S. Pat. No. 5,249,720 to White teaches a tool for applying support stockings that includes a tongue positioned between side rails which are connected to handles. The tongue includes an extension which is engaged by the handles to cause centering of the tongue between the side rails.

STILL YET ANOTHER EXAMPLE, U.S. Pat. No. 5,303,856 to Weatherholt, Sr. teaches a sock donning apparatus that includes a support post arranged to slidably mount a guide tube having a platform secured thereon. The platform includes a support arm with a generally U-shaped support plated that is oriented at an obtuse angle relative to the platform.

FINALLY, YET STILL ANOTHER EXAMPLE, U.S. Pat. No. 5,322,199 to White teaches an apparatus for assisting a person in putting on a stocking that includes an arcuate hollow form is releasibly attached to the upper edge of a stocking by clamp elements located at spaced points on the hollow form. Elongated straps extend from the clamping points.

It is apparent that numerous innovations for sock donning assist devices have been provided in the prior art that are adapted to be used. Furthermore, even though these innovations may be suitable for the specific individual purposes to which they address, they would not be suitable for the purposes of the present invention as heretofore described.

SUMMARY OF THE INVENTION

ACCORDINGLY, AN OBJECT of the present invention is to provide a multiple sock donning assist device that avoids the disadvantages of the prior art.

ANOTHER OBJECT of the present invention is to provide a multiple sock donning assist device that is simple and inexpensive to manufacture.

STILL ANOTHER OBJECT of the present invention is to provide a multiple sock donning assist device that is simple to use.

YET ANOTHER OBJECT of the present invention is to provide a multiple sock donning assist device that assist people who have difficulty from physical disabilities, such as a back, a hip or a leg impairment, in putting on footwear, such as socks and stockings either regular or support.

STILL YET ANOTHER OBJECT of the present invention is to provide a multiple sock donning assist device that eliminates difficulty, annoyance, possible pain, and aggravation, to the patient, when putting on footwear.

YET STILL ANOTHER OBJECT of the present invention is to provide a multiple sock donning assist device that enables both legs of the patient to be smoothly inserted into the stocking, which is already opened and ready for application, without having to drag the stocking on the ground.

STILL YET ANOTHER OBJECT of the present invention is to provide a sock donning assist device that allows a patient to put a stocking thereon and thereby giving the patient a sense of participation in their own care, a feeling of independence, and an elevation of their self-esteem.

BRIEFLY STATED, YET STILL ANOTHER OBJECT of the present invention is to provide a multiple sock donning assist device that includes a hollow horizontally-oriented and substantially opened-front base frame, a pair of hollow substantially vertically-oriented side frames, and a pair of hollow tandemly-positioned and substantially vertically-oriented intermediate frames.

STILL YET ANOTHER OBJECT of the present invention is to provide a sock donning assist device wherein the hollow horizontally-oriented and substantially opened-front base frame has ends.

YET STILL ANOTHER OBJECT of the present invention is to provide a multiple sock donning assist device wherein the pair of hollow substantially vertically-oriented side frames are gripped by a user and extend vertically upwardly and slightly rearwardly from the ends of the hollow horizontally-oriented and substantially opened-front base frame and have a height.

STILL YET ANOTHER OBJECT of the present invention is to provide a sock donning assist device wherein the pair of hollow tandemly-positioned and substantially vertically-oriented intermediate frames receive leg coverings and extend vertically upwardly and slightly rearwardly from the hollow horizontally-oriented and substantially opened-front base frame and are disposed intermediate the pair of hollow substantially vertically-oriented side frames, so that both legs of a user can be covered simultaneously.

YET STILL ANOTHER OBJECT of the present invention is to provide a multiple sock donning assist device wherein the hollow horizontally-oriented and substantially opened-front base frame includes a pair of straight, forwardly-tapering, spaced-apart, horizontally-oriented, and slender short side members.

STILL YET ANOTHER OBJECT of the present invention is to provide a sock donning assist device wherein each of the pair of straight, forwardly-tapering, spaced-apart, horizontally-oriented, and slender short side members of the hollow horizontally-oriented and substantially opened-front base frame have a front end, a back end, and an intermediate point.

YET STILL ANOTHER OBJECT of the present invention is to provide a multiple sock donning assist device wherein the hollow horizontally-oriented and substantially opened-front base frame further includes a straight, horizontally-oriented, and slender long back member that has a pair of ends, and two pair of substantially equally-spaced-apart intermediate points.

STILL YET ANOTHER OBJECT of the present invention is to provide a sock donning assist device wherein the straight, horizontally-oriented, and slender long back member of the hollow horizontally-oriented and substantially opened-front base frame, at each of the pair of ends of the straight, horizontally-oriented, and slender long back member of the hollow horizontally-oriented and substantially opened-front base frame, extends smoothly from the back end of each of the pair of straight, forwardly-tapering, spaced-apart, horizontally-oriented, and slender short side members of the hollow horizontally-oriented and substantially opened-front base frame and forms therewith a pair of smooth convexo-concave acute bends.

YET STILL ANOTHER OBJECT of the present invention is to provide a multiple sock donning assist device wherein the straight, horizontally-oriented, and slender long back member of the hollow horizontally-oriented and substantially opened-front base frame and the pair of straight, forwardly-tapering, spaced-apart, horizontally-oriented, and slender short side members of the hollow horizontally-oriented and substantially opened-front base frame lie in the same horizontal plane.

STILL YET ANOTHER OBJECT of the present invention is to provide a sock donning assist device wherein the hollow horizontally-oriented and substantially opened-front base frame further includes a pair of straight, horizontally-oriented, and slender front short outer members.

YET STILL ANOTHER OBJECT of the present invention is to provide a multiple sock donning assist device wherein each of the pair of straight, horizontally-oriented, and slender front short outer members of the hollow horizontally-oriented and substantially opened-front base frame have a proximal end, and a distal end.

STILL YET ANOTHER OBJECT of the present invention is to provide a sock donning assist device wherein each of the pair of straight, horizontally-oriented, and slender front short outer members of the hollow horizontally-oriented and substantially opened-front base frame, at the proximal end of each of the pair of straight, horizontally-oriented, and slender front short outer members of the hollow horizontally-oriented and substantially opened-front base frame, extend smoothly inwardly from the front end of each of the pair of straight, forwardly-tapering, spaced-apart, horizontally-oriented, and slender short side members of the hollow horizontally-oriented and substantially opened-front base frame and form therewith a pair of smooth convexo-concave obtuse bends.

YET STILL ANOTHER OBJECT of the present invention is to provide a multiple sock donning assist device wherein the pair of straight, horizontally-oriented, and slender front short outer members of the hollow horizontally-oriented and substantially opened-front base frame lie in the same horizontal plane as, are parallel to, and are disposed in front of, the straight, horizontally-oriented, and slender long back member of the hollow horizontally-oriented and substantially opened-front base frame.

STILL YET ANOTHER OBJECT of the present invention is to provide a sock donning assist device wherein the hollow horizontally-oriented and substantially opened-front base frame further includes a straight, horizontally-oriented, and slender front short intermediate member.

YET STILL ANOTHER OBJECT of the present invention is to provide a multiple sock donning assist device wherein the straight, horizontally-oriented, and slender front short intermediate member of the hollow horizontally-oriented and substantially opened-front base frame has a pair of ends.

STILL YET ANOTHER OBJECT of the present invention is to provide a sock donning assist device wherein the straight, horizontally-oriented, and slender front short intermediate member of the hollow horizontally-oriented and substantially opened-front base frame is disposed intermediate of, spaced from, and collinear with the pair of straight, horizontally-oriented, and slender front short outer members of the hollow horizontally-oriented and substantially opened-front base frame.

YET STILL ANOTHER OBJECT of the present invention is to provide a multiple sock donning assist device wherein each of the pair of hollow tandemly-positioned and substantially vertically-oriented intermediate frames include a pair of straight, parallelly-disposed, spaced-apart, substantially vertically-oriented, and slender short front lower members.

STILL YET ANOTHER OBJECT of the present invention is to provide a sock donning assist device wherein each of the pair of straight, parallelly-disposed, spaced-apart, substantially vertically-oriented, and slender short front lower members of each of the pair of hollow tandemly-positioned and substantially vertically-oriented intermediate frames have a lower end, and an upper end.

YET STILL ANOTHER OBJECT of the present invention is to provide a multiple sock donning assist device wherein each of the pair of straight, parallelly-disposed, spaced-apart, substantially vertically-oriented, and slender short front lower members of each of the pair of hollow tandemly-positioned and substantially vertically-oriented intermediate frames, at the lower end of each of the pair of straight, parallelly-disposed, spaced-apart, substantially vertically-oriented, and slender short front lower members of each of the pair of hollow tandemly-positioned and substantially vertically-oriented intermediate frames, extend abruptly upwardly and slightly rearwardly from the distal end of each of the pair of straight, horizontally-oriented, and slender front short outer members of the hollow horizontally-oriented and substantially opened-front base frame and extend abruptly upwardly and slightly rearwardly from each of the pair of ends of the straight, horizontally-oriented, and slender front short intermediate member of the hollow horizontally-oriented and substantially opened-front base frame, respectively, and are affixed thereto by suitable fastening means.

STILL YET ANOTHER OBJECT of the present invention is to provide a sock donning assist device wherein the pair of straight, parallelly-disposed, spaced-apart, substantially vertically-oriented, and slender short front lower members of each of the pair of hollow tandemly-positioned and substantially vertically-oriented intermediate frames are disposed forward of the straight, horizontally-oriented, and slender long back member of the hollow horizontally-oriented and substantially opened-front base frame and between the pair of straight, forwardly-tapering, spaced-apart, horizontally-oriented, and slender short side members of the hollow horizontally-oriented and substantially opened-front base frame.

YET STILL ANOTHER OBJECT of the present invention is to provide a multiple sock donning assist device wherein each of the pair of hollow tandemly-positioned and substantially vertically-oriented intermediate frames further include a pair of straight, parallelly-disposed, spaced-apart, substantially vertically-oriented, and slender short front intermediate members.

STILL YET ANOTHER OBJECT of the present invention is to provide a sock donning assist device wherein each of the pair of straight, parallelly-disposed, spaced-apart, substantially vertically-oriented, and slender short front intermediate members of each of the pair of hollow tandemly-positioned and substantially vertically-oriented intermediate frames have a lower end and an upper end.

YET STILL ANOTHER OBJECT of the present invention is to provide a multiple sock donning assist device wherein each of the pair of straight, parallelly-disposed, spaced-apart, substantially vertically-oriented, and slender short front intermediate members of each of the pair of hollow tandemly-positioned and substantially vertically-oriented intermediate frames, at the lower end of each of the pair of straight, parallelly-disposed, spaced-apart, substantially vertically-oriented, and slender short front intermediate members of each of the pair of hollow tandemly-positioned and substantially vertically-oriented intermediate frames, extend smoothly upwardly and rearwardly from the upper end of each of the pair of straight, parallelly-disposed, spaced-apart, substantially vertically-oriented, and slender short front lower members of each of the pair of hollow tandemly-positioned and substantially vertically-oriented intermediate frames and form therewith two pair of smooth convexo-concave obtuse bends.

STILL YET ANOTHER OBJECT of the present invention is to provide a sock donning assist device wherein the pair of straight, parallelly-disposed, spaced-apart, substantially vertically-oriented, and slender short front intermediate members of each of the pair of hollow tandemly-positioned and substantially vertically-oriented intermediate frames are disposed in front of the straight, horizontally-oriented, and slender long back member of the hollow horizontally-oriented and substantially opened-front base frame and between the pair of straight, forwardly-tapering, spaced-apart, horizontally-oriented, and slender short side members of the hollow horizontally-oriented and substantially opened-front base frame.

YET STILL ANOTHER OBJECT of the present invention is to provide a multiple sock donning assist device wherein each of the pair of hollow tandemly-positioned and substantially vertically-oriented intermediate frames further include a pair of straight, parallelly-disposed, spaced-apart, substantially vertically-oriented, and slender long front upper members.

STILL YET ANOTHER OBJECT of the present invention is to provide a sock donning assist device wherein each of the pair of straight, parallelly-disposed, spaced-apart, substantially vertically-oriented, and slender long front upper members of each of the pair of hollow tandemly-positioned and substantially vertically-oriented intermediate frames have a lower end and an upper end.

YET STILL ANOTHER OBJECT of the present invention is to provide a multiple sock donning assist device wherein each of the pair of straight, parallelly-disposed, spaced-apart, substantially vertically-oriented, and slender long front upper members of each of the pair of hollow tandemly-positioned and substantially vertically-oriented intermediate frames, at the lower end of each of the pair of straight, parallelly-disposed, spaced-apart, substantially vertically-oriented, and slender long front upper members of each of the pair of hollow tandemly-positioned and substantially vertically-oriented intermediate frames, extend smoothly upwardly and slightly rearwardly from the upper end of each of the pair of straight, parallelly-disposed, spaced-apart, substantially vertically-oriented, and slender short front intermediate members of each of the pair of hollow tandemly-positioned and substantially vertically-oriented intermediate frames and form therewith two pair of smooth convexo-concave obtuse bends.

STILL YET ANOTHER OBJECT of the present invention is to provide a sock donning assist device wherein the pair of straight, parallelly-disposed, spaced-apart, substantially vertically-oriented, and slender long front upper members of each of the pair of hollow tandemly-positioned and substantially vertically-oriented intermediate frames are disposed in front of the straight, horizontally-oriented, and slender long back member of the hollow horizontally-oriented and substantially opened-front base frame, between the pair of straight, forwardly-tapering, spaced-apart, horizontally-oriented, and slender short side members of the hollow horizontally-oriented and substantially opened-front base frame, and behind of, and substantially parallel to, the pair of straight, parallelly-disposed, spaced-apart, substantially vertically-oriented, and slender short front lower members of each of the pair of hollow tandemly-positioned and substantially vertically-oriented intermediate frames.

YET STILL ANOTHER OBJECT of the present invention is to provide a multiple sock donning assist device wherein each of the pair of hollow tandemly-positioned and substantially vertically-oriented intermediate frames further include a U-shaped, horizontally oriented, forwardly opening, and slender top member.

STILL YET ANOTHER OBJECT of the present invention is to provide a sock donning assist device wherein the U-shaped, horizontally oriented, forwardly opening, and slender top member of each of the pair of hollow tandemly-positioned and substantially vertically-oriented intermediate frames have a pair of ends, and a midpoint.

YET STILL ANOTHER OBJECT of the present invention is to provide a multiple sock donning assist device wherein the U-shaped, horizontally oriented, forwardly opening, and slender top member of each of the pair of hollow tandemly-positioned and substantially vertically-oriented intermediate frames, at each of the pair of ends of the U-shaped, horizontally oriented, forwardly opening, and slender top member of each of the pair of hollow tandemly-positioned and substantially vertically-oriented intermediate frames, extend smoothly rearwardly from the upper end of each of the pair of straight, parallelly-disposed, spaced-apart, substantially vertically-oriented, and slender long front upper members of each of the pair of hollow tandemly-positioned and substantially vertically-oriented intermediate frames and form therewith two pair of smooth convexo-concave obtuse bends.

STILL YET ANOTHER OBJECT of the present invention is to provide a sock donning assist device wherein the U-shaped, horizontally oriented, forwardly opening, and slender top member of each of the pair of hollow tandemly-positioned and substantially vertically-oriented intermediate frames are disposed in front of the straight, horizontally-oriented, and slender long back member of the hollow horizontally-oriented and substantially opened-front base frame, between the pair of straight, forwardly-tapering, spaced-apart, horizontally-oriented, and slender short side members of the hollow horizontally-oriented and substantially opened-front base frame, and behind the pair of straight, parallelly-disposed, spaced-apart, substantially vertically-oriented, and slender short front lower members of each of the pair of hollow tandemly-positioned and substantially vertically-oriented intermediate frames.

YET STILL ANOTHER OBJECT of the present invention is to provide a multiple sock donning assist device wherein each of the pair of hollow tandemly-positioned and substantially vertically-oriented intermediate frames further include a pair of straight, parallelly-disposed, spaced-apart, horizontally-oriented, and slender short back lower members.

STILL YET ANOTHER OBJECT of the present invention is to provide a sock donning assist device wherein each of the pair of straight, parallelly-disposed, spaced-apart, horizontally-oriented, and slender short lower back members of each of the pair of hollow tandemly-positioned and substantially vertically-oriented intermediate frames have a front and a rear end.

YET STILL ANOTHER OBJECT of the present invention is to provide a multiple sock donning assist device wherein each of the pair of straight, parallelly-disposed, spaced-apart, horizontally-oriented, and slender short back lower members of each of the pair of hollow tandemly-positioned and substantially vertically-oriented intermediate frames, at the rear end of each of the pair of straight, parallelly-disposed, spaced-apart, horizontally-oriented, and slender short back lower members of each of the pair of hollow tandemly-positioned and substantially vertically-oriented intermediate frames, extend abruptly forwardly from each of the two pair of substantially equal-spaced-apart intermediate points of the straight, horizontally-oriented, and slender long back member of the hollow horizontally-oriented and substantially opened-front base frame and is affixed thereto by the suitable fastening means.

STILL YET ANOTHER OBJECT of the present invention is to provide a sock donning assist device wherein the pair of straight, parallelly-disposed, spaced-apart, horizontally-oriented, and slender short back lower members of each of the pair of hollow tandemly-positioned and substantially vertically-oriented intermediate frames are disposed between the pair of straight, forwardly-tapering, spaced-apart, horizontally-oriented, and slender short side members of the hollow horizontally-oriented and substantially opened-front base frame and behind the pair of straight, parallelly-disposed, spaced-apart, substantially vertically-oriented, and slender long front upper members of each of the pair of hollow tandemly-positioned and substantially vertically-oriented intermediate frames.

YET STILL ANOTHER OBJECT of the present invention is to provide a multiple sock donning assist device wherein each of the pair of hollow tandemly-positioned and substantially vertically-oriented intermediate frames further include a pair of straight, slightly inwardly tapering, substantially vertically-oriented, and slender long back intermediate members.

STILL YET ANOTHER OBJECT of the present invention is to provide a sock donning assist device wherein each of the pair of straight, slightly inwardly tapering, substantially vertically-oriented, and slender long back intermediate members of each of the pair of hollow tandemly-positioned and substantially vertically-oriented intermediate frames have a lower end and an upper end.

YET STILL ANOTHER OBJECT of the present invention is to provide a multiple sock donning assist device wherein each of the pair of straight, slightly inwardly tapering, substantially vertically-oriented, and slender long back intermediate members of each of the pair of hollow tandemly-positioned and substantially vertically-oriented intermediate frames, at the lower end of each of the pair of straight, slightly inwardly tapering, substantially vertically-oriented, and slender long back intermediate members of each of the pair of hollow tandemly-positioned and substantially vertically-oriented intermediate frames, extend smoothly upwardly and slightly rearwardly from the front end of each of the pair of straight, parallelly-disposed, spaced-apart, horizontally-oriented, slender short back lower members of each of the pair of hollow tandemly-positioned and substantially vertically-oriented intermediate frames and form therewith two pair of smooth convexo-concave acute bends.

STILL YET ANOTHER OBJECT of the present invention is to provide a sock donning assist device wherein the pair of straight, slightly inwardly tapering, substantially vertically-oriented, and slender long back members of each of the pair of hollow tandemly-positioned and substantially vertically-oriented intermediate frames are disposed between the pair of straight, forwardly-tapering, spaced-apart, horizontally-oriented, and slender short side members of the hollow horizontally-oriented and substantially opened-front base frame, in front of the straight, horizontally-oriented, and slender long back member of the hollow horizontally-oriented and substantially opened-front base frame, and behind the pair of straight, parallelly-disposed, spaced-apart, substantially vertically-oriented, and slender long front upper members of each of the pair of hollow tandemly-positioned and substantially vertically-oriented intermediate frames.

YET STILL ANOTHER OBJECT of the present invention is to provide a multiple sock donning assist device wherein each of the pair of hollow tandemly-positioned and substantially vertically-oriented intermediate frames further include a semi-circular, substantially vertically-oriented, and slender back upper connecting member.

STILL YET ANOTHER OBJECT of the present invention is to provide a sock donning assist device wherein the semi-circular, substantially vertically-oriented, and slender back upper connecting member of each of the pair of hollow tandemly-positioned and substantially vertically-oriented intermediate frames have a pair of ends, and a midpoint.

YET STILL ANOTHER OBJECT of the present invention is to provide a multiple sock donning assist device wherein the semi-circular, substantially vertically-oriented, and slender back upper connecting member of each of the pair of hollow tandemly-positioned and substantially vertically-oriented intermediate frames, at each of the pair of ends of the semi-circular, substantially vertically-oriented, and slender back upper connecting member of each of the pair of hollow tandemly-positioned and substantially vertically-oriented intermediate frames, extend smoothly upwardly and slightly rearwardly from the upper end of each of the pair of straight, slightly inwardly tapering, substantially vertically-oriented, and slender long back intermediate members of each of the pair of hollow tandemly-positioned and substantially vertically-oriented intermediate frames and form therewith two pair of smooth convexo-concave smooth bends.

STILL YET ANOTHER OBJECT of the present invention is to provide a sock donning assist device wherein the midpoint of the semi-circular, substantially vertically-oriented, and slender back upper connecting member of each of the pair of hollow tandemly-positioned and substantially vertically-oriented intermediate frames are affixed to the midpoint of the U-shaped, horizontally oriented, forwardly opening, and slender top member of each of the pair of hollow tandemly-positioned and substantially vertically-oriented intermediate frames by the suitable fastening means.

YET STILL ANOTHER OBJECT of the present invention is to provide a multiple sock donning assist device wherein the semi-circular, substantially vertically-oriented, and slender back upper connecting member of each of the pair of hollow tandemly-positioned and substantially vertically-oriented intermediate frames are disposed between the pair of straight, forwardly-tapering, spaced-apart, horizontally-oriented, and slender short side members of the hollow horizontally-oriented and substantially opened-front base frame, in front of the straight, horizontally-oriented, and slender long back member of the hollow horizontally-oriented and substantially opened-front base frame, and behind the pair of straight, parallelly-disposed, spaced-apart, substantially vertically-oriented, and slender long front upper members of each of the pair of hollow tandemly-positioned and substantially vertically-oriented intermediate frames.

STILL YET ANOTHER OBJECT of the present invention is to provide a sock donning assist device wherein each of the pair hollow substantially vertically-oriented side frames include a straight, substantially vertically-oriented, and slender long back member.

YET STILL ANOTHER OBJECT of the present invention is to provide a multiple sock donning assist device wherein straight, substantially vertically-oriented, and slender long back member of each of the pair hollow substantially vertically-oriented side frames have a lower end, an upper end, a length, and an intermediate point.

STILL YET ANOTHER OBJECT of the present invention is to provide a sock donning assist device wherein the straight, substantially vertically-oriented, and slender long back member of each of the pair hollow substantially vertically-oriented side frames, at the lower end of the straight, substantially vertically-oriented, and slender long back member of each of the pair hollow substantially vertically-oriented side frames, extend abruptly upwardly and slightly rearwardly from the back end of each of the pair of straight, forwardly-tapering, spaced-apart, horizontally-oriented, and slender short side members of the hollow horizontally-oriented and substantially opened-front base frame.

YET STILL ANOTHER OBJECT of the present invention is to provide a multiple sock donning assist device wherein the straight, substantially vertically-oriented, and slender long back member of each of the pair hollow substantially vertically-oriented side frames are disposed in front of the straight, horizontally-oriented, and slender long back member of the hollow horizontally-oriented and substantially opened-front base frame, and behind the pair of straight, slightly inwardly tapering, substantially vertically-oriented, and slender long back intermediate members of each of the pair of hollow tandemly-positioned and substantially vertically-oriented intermediate frames.

STILL YET ANOTHER OBJECT of the present invention is to provide a sock donning assist device wherein the length of the straight, substantially vertically-oriented, and slender long back member of each of the pair hollow substantially vertically-oriented side frames is greater than the height of the pair of hollow tandemly-positioned and substantially vertically-oriented intermediate frames.

YET STILL ANOTHER OBJECT of the present invention is to provide a multiple sock donning assist device wherein each of the pair hollow substantially vertically-oriented side frames further include a straight, substantially horizontally-oriented, and slender short top member.

STILL YET ANOTHER OBJECT of the present invention is to provide a sock donning assist device wherein the straight, substantially horizontally-oriented, and slender short top member of each of the pair of hollow substantially vertically-oriented side frames have a rear end, and a front end.

YET STILL ANOTHER OBJECT of the present invention is to provide a multiple sock donning assist device wherein the straight, substantially horizontally-oriented, and slender short top member of each of the pair hollow substantially vertically-oriented side frames, at the rear end of the straight, substantially horizontally-oriented, and slender short top member of each of the pair hollow substantially vertically-oriented side frames, extend smoothly forwardly and slightly upwardly from the upper end of the straight, substantially vertically-oriented, and slender long back member of each of the pair hollow substantially vertically-oriented side frames and form therewith a pair of smooth convexo-concave normal bends.

STILL YET ANOTHER OBJECT of the present invention is to provide a sock donning assist device wherein the straight, substantially horizontally-oriented, and slender short top member of each of the pair hollow substantially vertically-oriented side frames are disposed above the pair hollow substantially vertically-oriented side frames.

YET STILL ANOTHER OBJECT of the present invention is to provide a multiple sock donning assist device wherein each of the pair hollow substantially vertically-oriented side frames further include a straight, substantially vertically-oriented, and slender short front member.

STILL YET ANOTHER OBJECT of the present invention is to provide a sock donning assist device wherein the straight, substantially vertically-oriented, and slender short front member of each of the pair of hollow substantially vertically-oriented side frames have an upper end, and a lower end.

YET STILL ANOTHER OBJECT of the present invention is to provide a multiple sock donning assist device wherein the straight, substantially vertically-oriented, and slender short front member of each of the pair hollow substantially vertically-oriented side frames, at the upper end of the straight, substantially vertically-oriented, and slender short front member of each of the pair hollow substantially vertically-oriented side frames, extend smoothly downwardly and slightly forwardly from the front end of the straight, substantially horizontally-oriented, and slender short top member of each of the pair hollow substantially vertically-oriented side frames and form therewith a pair of smooth convexo-concave normal bends.

STILL YET ANOTHER OBJECT of the present invention is to provide a sock donning assist device wherein the straight, substantially vertically-oriented, and slender short front member of each of the pair hollow substantially vertically-oriented side frames are disposed in front of, and substantially parallel to, the straight, substantially vertically-oriented, and slender long back member of each of the pair hollow substantially vertically-oriented side frames.

YET STILL ANOTHER OBJECT of the present invention is to provide a multiple sock donning assist device wherein each of the pair hollow substantially vertically-oriented side frames further include a straight, substantially horizontally-oriented, and slender short intermediate member.

STILL YET ANOTHER OBJECT of the present invention is to provide a sock donning assist device wherein the straight, substantially horizontally-oriented, and slender short intermediate member of each of the pair of hollow substantially vertically-oriented side frames have a front end, and a rear end.

YET STILL ANOTHER OBJECT of the present invention is to provide a multiple sock donning assist device wherein the straight, substantially horizontally-oriented, and slender short intermediate member of each of the pair hollow substantially vertically-oriented side frames, at the front end of the straight, substantially horizontally-oriented, and slender short intermediate member of each of the pair hollow substantially vertically-oriented side frames, extend smoothly rearwardly and slightly downwardly from the lower end of the straight, substantially horizontally-oriented, and slender short front member of each of the pair hollow substantially vertically-oriented side frames and form therewith a pair of smooth convexo-concave normal bends.

STILL YET ANOTHER OBJECT of the present invention is to provide a sock donning assist device wherein the straight, substantially horizontally-oriented, and slender short intermediate member of each of the pair hollow substantially vertically-oriented side frames, at the rear end of the straight, substantially horizontally-oriented, and slender short intermediate member of each of the pair hollow substantially vertically-oriented side frames, extend abruptly forwardly and slightly upwardly from the intermediate point of the straight, substantially vertically-oriented, and slender long back member of each of the pair hollow substantially vertically-oriented side frames and are affixed thereto by the suitable fastening means.

YET STILL ANOTHER OBJECT of the present invention is to provide a multiple sock donning assist device wherein the straight, substantially horizontally-oriented, and slender short intermediate member of each of the pair of hollow substantially vertically-oriented side frames are disposed below, and substantially parallel to, and have substantially the same length as, the straight, substantially horizontally-oriented, and slender short top member of each of the pair of hollow substantially vertically-oriented side frames, and are disposed above the pair of hollow substantially vertically-oriented side frames.

STILL YET ANOTHER OBJECT of the present invention is to provide a sock donning assist device wherein the straight, substantially horizontally-oriented, and slender short top member of each of the pair hollow substantially vertically-oriented side frames, together with the straight, substantially vertically-oriented, and slender short front member of each of the pair hollow substantially vertically-oriented side frames, together with the straight, substantially horizontally-oriented, and slender short intermediate member of each of the pair hollow substantially vertically-oriented side frames, and together with the part of the straight, substantially vertically-oriented, and slender long back member of each of the pair hollow substantially vertically-oriented side frames that is intermediate the upper end of the straight, substantially vertically-oriented, and slender long back member of each of the pair hollow substantially vertically-oriented side frames and the intermediate point of the straight, substantially vertically-oriented, and slender long back member of each of the pair hollow substantially vertically-oriented side frames form a pair of hand grips.

YET STILL ANOTHER OBJECT of the present invention is to provide a multiple sock donning assist device wherein each of the pair hollow substantially vertically-oriented side frames further include a straight, substantially vertically-oriented, and slender long reinforcement member.

STILL YET ANOTHER OBJECT of the present invention is to provide a sock donning assist device wherein the straight, substantially vertically-oriented, and slender long reinforcement. member of each of the pair of hollow substantially vertically-oriented side frames have an upper end, and a lower end.

YET STILL ANOTHER OBJECT of the present invention is to provide a multiple sock donning assist device wherein the straight, substantially vertically-oriented, and slender long reinforcement member of each of the pair hollow substantially vertically-oriented side frames, at the lower end of the straight, substantially vertically-oriented, and slender long reinforcement member of each of the pair hollow substantially vertically-oriented side frames, extend abruptly upwardly and slightly rearwardly from the intermediate point of each of the pair of straight, forwardly-tapering, spaced-apart, horizontally-oriented, and slender short side members of the hollow horizontally-oriented and substantially opened-front base frame and are affixed thereto by the suitable fastening means.

STILL YET ANOTHER OBJECT of the present invention is to provide a sock donning assist device wherein the straight, substantially vertically-oriented, and slender long reinforcement member of each of the pair hollow substantially vertically-oriented side frames, at the upper end of the straight, substantially vertically-oriented, and slender long reinforcement. member of each of the pair hollow substantially vertically-oriented side frames, extend abruptly downwardly and slightly forwardly from the intermediate point of the straight, substantially vertically-oriented, and slender long back member of each of the pair hollow substantially vertically-oriented side frames and are affixed thereto by the suitable fastening means.

FINALLY, YET STILL ANOTHER OBJECT of the present invention is to provide a method for using a multiple sock donning assist device that includes the steps of placing a lower portion of a leg covering through a U-shaped, horizontally oriented, forwardly opening, and slender top member of each of a pair of hollow tandemly-positioned and substantially vertically-oriented intermediate frames of the multiple leg covering donning assist device with the lower portion of the leg covering positioned in the interior space of each of the pair of hollow tandemly-positioned and substantially vertically-oriented intermediate frames; stretching an upper portion of the leg covering over the U-shaped, horizontally oriented, forwardly opening, and slender top member of each of the pair of hollow tandemly-positioned and substantially vertically-oriented intermediate frames; pulling down the upper portion of the leg covering over the exterior of each of the pair of hollow tandemly-positioned and substantially vertically-oriented intermediate frames so as to be compressingly secured thereto; wrapping the pair of hands of a user around a straight, substantially horizontally-oriented, and slender short top member of each of a pair of hollow substantially vertically-oriented side frames of the multiple leg covering donning assist device in a securely gripping fashion; inserting the legs of the user into the lower portion of the leg covering; pulling gently upward the combination of the multiple sock donning assist device and the leg covering on the legs of the user; pulling the upper portion of the leg covering up and off the exterior of the pair of hollow tandemly-positioned and substantially vertically-oriented intermediate frames, as the multiple sock donning assist device 10 and the leg covering are gently pulled upwardly on the legs of the user, and becoming compressingly secured to the user; and removing the multiple sock donning assist device with the legs of the user, leaving the U-shaped, horizontally oriented, forwardly opening, and slender top member of each of the pair of hollow tandemly-positioned and substantially vertically-oriented intermediate frames, so that both legs are covered simultaneously.

The novel features which are considered characteristic of the present invention are set forth in the appended claims. The invention itself, however, both as to its construction and its method of operation, together with additional objects and advantages thereof, will be best understood from the following description of the specific embodiments when read and understood in connection with the accompanying drawing.

BRIEF DESCRIPTION OF THE DRAWING

The figures on the drawing are briefly described as follows.

LIST OF REFERENCE NUMERALS UTILIZED IN THE DRAWING

Figure 1:
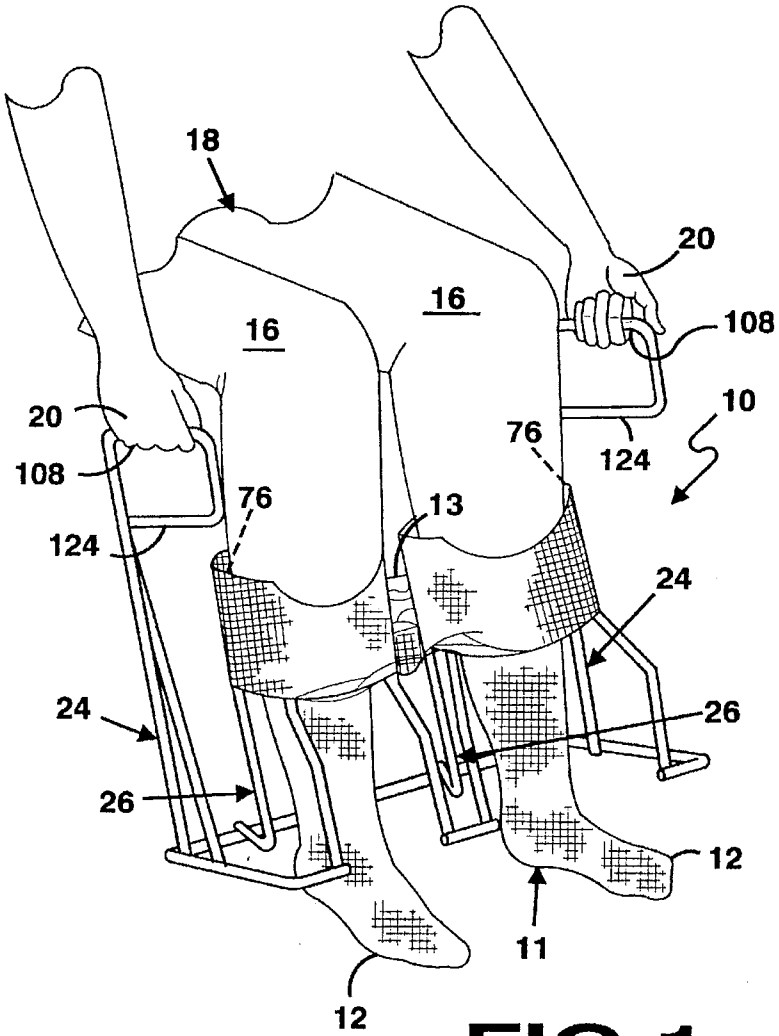
FIG. 1 is a diagrammatic perspective view illustrating the present invention being utilized to don a pantyhose.

10 multiple sock donning assist device of the present invention
11 pantyhose
12 pair of pantyhose lower portions
13 pantyhose upper portion
16 pair of user legs
18 user
20 pair of user hands
22 hollow horizontally-oriented and substantially opened-front base frame
24 pair hollow substantially vertically-oriented side frames
26 pair of hollow tandemly-positioned and substantially vertically-oriented intermediate frames
28 pair of straight, forwardly-tapering, spaced-apart, horizontally-oriented, and slender base frame short side members
30 base frame short side member front end
32 base frame short side member back end
33 base frame short side member intermediate point
34 straight, horizontally-oriented, and slender base frame long back member
36 pair of base frame long back member ends
37 two pair of substantially equally-spaced-apart base frame long back member intermediate points
38 pair of base frame back long member smooth convexo-concave acute bends
40 pair of straight, horizontally-oriented, and slender base frame front short outer members
42 base frame front short outer member proximal end
44 base frame front short outer member distal end
46 pair of base frame front short outer member smooth convexo-concave obtuse bends
48 straight, horizontally-oriented, and slender base frame front short intermediate member
50 pair of base frame front short intermediate member ends
52 pair of straight, parallelly-disposed, spaced-apart, substantially vertically-oriented, and slender intermediate frame short front lower members
54 intermediate frame short front lower member lower end
56 intermediate frame short front lower member upper end
58 suitable fastening means 58
60 pair of straight, parallelly-disposed, spaced-apart, substantially vertically-oriented, and slender intermediate frame short front intermediate members
62 intermediate frame short front intermediate member lower end 64 intermediate frame short front intermediate member upper end
65 ledge
66 two pair of intermediate frame front lower member smooth convexo-concave obtuse bends
68 pair of straight, parallelly-disposed, spaced-apart, substantially vertically-oriented, and slender intermediate frame long front upper members
70 intermediate frame long front upper member lower end
72 intermediate frame long front upper member upper end
74 two pair of intermediate frame front intermediate member smooth convexo-concave obtuse bends
76 U-shaped, horizontally oriented, forwardly opening, and slender intermediate frame top member
78 pair of intermediate frame top member ends
79 intermediate frame top member midpoint
80 two pair of intermediate frame top smooth convexo-concave obtuse bends
82 pair of straight, parallelly-disposed, spaced-apart, horizontally-oriented, and slender intermediate frame short back lower members
84 intermediate frame short back lower member front end
86 intermediate frame short back lower member rear end
88 pair of straight, slightly inwardly tapering, substantially vertically-oriented, and slender intermediate frame long back intermediate members
90 intermediate frame long back intermediate member lower end
92 intermediate frame long back intermediate member upper end
93 two pair of intermediate frame back intermediate member smooth convexo-concave acute bends
94 semi-circular, substantially vertically-oriented, and slender intermediate frame back upper connecting member
96 pair of intermediate frame back upper connecting member ends
98 intermediate frame back upper connecting member midpoint
100 two pair of intermediate frame back upper member smooth convexo-concave smooth bends
102 straight, substantially vertically-oriented, and slender side frame long back member
104 side frame long back member lower end
106 side frame long back member upper end
107 side frame back member intermediate point
108 straight, substantially horizontally-oriented, and slender side frame short top member
110 side frame short top member rear end
112 side frame short top member front end
114 pair of side frame back member smooth convexo-concave normal bends
116 straight, substantially vertically-oriented, and slender side frame short front member
118 side frame short front member upper end
120 side frame short front member lower end
122 pair of side frame top member smooth convexo-concave normal bends
124 straight, substantially horizontally-oriented, and slender side frame short intermediate member
126 side frame short intermediate member front end
128 side frame short intermediate member rear end
130 pair of side frame front member smooth convexo-concave normal bends
132 pair of hand grips
134 straight, substantially vertically-oriented, and slender side frame long reinforcement member
136 side frame long reinforcement member upper end
138 side frame long reinforcement member lower end

DETAILED DESCRIPTION OF THE PREFERRED EMBODIMENT

Referring now to the figures in which like numerals indicate like parts, and particularly to FIG. 1, the multiple sock donning assist device of the present invention is shown generally at 10 donning a pantyhose 11, with a pair of pantyhose lower portions 12 and a pantyhose upper portion 13, onto a pair of user legs 16 of a user 18, by a pair of user hands 20 of the user 18.

The use of the pantyhose 11 is for illustrative purposes only and that the multiple sock donning assist device 10 can be used for simultaneously donning multiple leg coverings, such as but not limited to, suppose hose, knee high socks and the like.

The configuration of the multiple sock donning assist device 10 can best be seen in FIG. 2 and 3, and as such, will be discussed with reference thereto.

The multiple sock donning assist device 10 can be made from metal or plastic, but is not limited to that, and consists of a plurality of slender members of specific lengths and shapes.

The multiple sock donning assist device 10 includes a hollow horizontally-oriented and substantially opened-front base frame 22, a pair hollow substantially vertically-oriented side frames 24 for gripping by the user 18 and extending vertically upwardly and slightly rearwardly from the ends of the hollow horizontally-oriented and substantially opened-front base frame 22, and a pair of hollow tandemly-positioned and substantially vertically-oriented intermediate frames 26 for receiving the pantyhose 11 and extending vertically upwardly and slightly rearwardly from the hollow horizontally-oriented and substantially opened-front base frame 22 and being intermediate the pair hollow substantially vertically-oriented side frames 24.

The hollow horizontally-oriented and substantially opened-front base frame 22 includes a pair of straight, forwardly-tapering, spaced-apart, horizontally-oriented, and slender base frame short side members 28. Each of the pair of straight, forwardly-tapering, spaced-apart, horizontally-oriented, and slender base frame short side members 28 of the hollow horizontally-oriented and substantially opened-front base frame 22 have a base frame short side member front end 30, a base frame short side member back end 32, and a base frame short side member intermediate point 33.

The hollow horizontally-oriented and substantially opened-front base frame 22 further includes a straight, horizontally-oriented, and slender base frame long back member 34 having a pair of base frame long back member ends 36, and two pair of substantially equally-spaced-apart base frame long back member intermediate points 37.

The straight, horizontally-oriented, and slender base frame long back member 34 of the hollow horizontally-oriented and substantially opened-front base frame 22, at each of the pair of base frame long back member ends 36 of the straight, horizontally-oriented, and slender base frame long back member 34 of the hollow horizontally-oriented and substantially opened-front base frame 22, extends smoothly from the base frame short side member back end 32 of each of the pair of straight, forwardly-tapering, spaced-apart, horizontally-oriented, and slender base frame short side members 28 of the hollow horizontally-oriented and substantially opened-front base frame 22 and forms therewith a pair of base frame back long member smooth convexo-concave acute bends 38.

The straight, horizontally-oriented, and slender base frame long back member 34 of the hollow horizontally-oriented and substantially opened-front base frame 22 and the pair of straight, forwardly-tapering, spaced-apart, horizontally-oriented, and slender base frame short side members 28 of the hollow horizontally-oriented and substantially opened-front base frame 22 lie in the same horizontal plane.

The hollow horizontally-oriented and substantially opened-front base frame 22 further includes a pair of straight, horizontally-oriented, and slender base frame front short outer members 40. Each of the pair of straight, horizontally-oriented, and slender base frame front short outer members 40 of the hollow horizontally-oriented and substantially opened-front base frame 22 have a base frame front short outer member proximal end 42, and a base frame front short outer member distal end 44.

Each of the pair of straight, horizontally-oriented, and slender base frame front short outer members 40 of the hollow horizontally-oriented and substantially opened-front base frame 22, at the base frame front short outer member proximal end 42 of each of the pair of straight, horizontally-oriented, and slender base frame front short outer members 40 of the hollow horizontally-oriented and substantially opened-front base frame 22, extend smoothly inwardly from the base frame short side member front end 30 of each of the pair of straight, forwardly-tapering, spaced-apart, horizontally-oriented, and slender base frame short side members 28 of the hollow horizontally-oriented and substantially opened-front base frame 22 and form therewith a pair of base frame front short outer member smooth convexo-concave obtuse bends 46.

The pair of straight, horizontally-oriented, and slender base frame front short outer members 40 of the hollow horizontally-oriented and substantially opened-front base frame 22 lie in the same horizontal plane as, are parallel to, and are disposed in front of the straight, horizontally-oriented, and slender base frame long back member 34 of the hollow horizontally-oriented and substantially opened-front base frame 22.

The hollow horizontally-oriented and substantially opened-front base frame 22 further includes a straight, horizontally-oriented, and slender base frame front short intermediate member 48. The straight, horizontally-oriented, and slender base frame front short intermediate member 48 of the hollow horizontally-oriented and substantially opened-front base frame 22 has a pair of base frame front short intermediate member ends 50.

The straight, horizontally-oriented, and slender base frame front short intermediate member 48 of the hollow horizontally-oriented and substantially opened-front base frame 22 is disposed intermediate of, spaced from, and collinear with the pair of straight, horizontally-oriented, and slender base frame front short outer members 40 of the hollow horizontally-oriented and substantially opened-front base frame 22.

Each of the pair of hollow tandemly-positioned and substantially vertically-oriented intermediate frames 26 include a pair of straight, parallelly-disposed, spaced-apart, substantially vertically-oriented, and slender intermediate frame short front lower members 52. Each of the pair of straight, parallelly-disposed, spaced-apart, substantially vertically-oriented, and slender intermediate frame short front lower members 52 of each of the pair of hollow tandemly-positioned and substantially vertically-oriented intermediate frames 26 have an intermediate frame short front lower member lower end 54, and an intermediate frame short front lower member upper end 56.

Each of the pair of straight, parallelly-disposed, spaced-apart, substantially vertically-oriented, and slender intermediate frame short front lower members 52 of each of the pair of hollow tandemly-positioned and substantially vertically-oriented intermediate frames 26, at the intermediate frame short front lower member lower end 54 of each of the pair of straight, parallelly-disposed, spaced-apart, substantially vertically-oriented, and slender intermediate frame short front lower members 52 of each of the pair of hollow tandemly-positioned and substantially vertically-oriented intermediate frames 26, extend abruptly upwardly and slightly rearwardly from the base frame front short outer member distal end 44 of each of the pair of straight, horizontally-oriented, and slender base frame front short outer members 40 of the hollow horizontally-oriented and substantially opened-front base frame 22 and extend abruptly upwardly and slightly rearwardly from each of the pair of base frame front short intermediate member ends 50 of the straight, horizontally-oriented, and slender base frame front short intermediate member 48 of the hollow horizontally-oriented and substantially opened-front base frame 22, respectively, and are affixed thereto by suitable fastening means 58 that is compatible with the material of the multiple sock donning assist device 10, such as, but not limited to, solder, epoxy or the like.

The pair of straight, parallelly-disposed, spaced-apart, substantially vertically-oriented, and slender intermediate frame short front lower members 52 of each of the pair of hollow tandemly-positioned and substantially vertically-oriented intermediate frames 26 are disposed forward of the straight, horizontally-oriented, and slender base frame long back member 34 of the hollow horizontally-oriented and substantially opened-front base frame 22 and inward of the pair of straight, forwardly-tapering, spaced-apart, horizontally-oriented, and slender base frame short side members 28 of the hollow horizontally-oriented and substantially opened-front base frame 22.

Each of the pair of hollow tandemly-positioned and substantially vertically-oriented intermediate frames 26 further include a pair of straight, parallelly-disposed, spaced-apart, substantially vertically-oriented, and slender intermediate frame short front intermediate members 60. Each of the pair of straight, parallelly-disposed, spaced-apart, substantially vertically-oriented, and slender intermediate frame short front intermediate members 60 of each of the pair of hollow tandemly-positioned and substantially vertically-oriented intermediate frames 26 have an intermediate frame short front intermediate member lower end 62 and an intermediate frame short front intermediate member upper end 64.

The pair of straight, parallelly-disposed, spaced-apart, substantially vertically-oriented, and slender intermediate frame short front intermediate members 60 of the pair of hollow tandemly-positioned and substantially vertically-oriented intermediate frames 26 function as a ledge 65.

Each of the pair of straight, parallelly-disposed, spaced-apart, substantially vertically-oriented, and slender intermediate frame short front intermediate members 60 of each of the pair of hollow tandemly-positioned and substantially vertically-oriented intermediate frames 26, at the intermediate frame short front intermediate member lower end 62 of each of the pair of straight, parallelly-disposed, spaced-apart, substantially vertically-oriented, and slender intermediate frame short front intermediate members 60 of each of the pair of hollow tandemly-positioned and substantially vertically-oriented intermediate frames 26, extend smoothly upwardly and rearwardly from the intermediate frame short front lower member upper end 56 of each of the pair of straight, parallelly-disposed, spaced-apart, substantially vertically-oriented, and slender intermediate frame short front lower members 52 of each of the pair of hollow tandemly-positioned and substantially vertically-oriented intermediate frames 26 and form therewith two pair of intermediate frame front lower member smooth convexo-concave obtuse bends 66.

The pair of straight, parallelly-disposed, spaced-apart, substantially vertically-oriented, and slender intermediate frame short front intermediate members 60 of each of the pair of hollow tandemly-positioned and substantially vertically-oriented intermediate frames 26 are disposed forward of the straight, horizontally-oriented, and slender base frame long back member 34 of the hollow horizontally-oriented and substantially opened-front base frame 22 and inward of the pair of straight, forwardly-tapering, spaced-apart, horizontally-oriented, and slender base frame short side members 28 of the hollow horizontally-oriented and substantially opened-front base frame 22.

Each of the pair of hollow tandemly-positioned and substantially vertically-oriented intermediate frames 26 further include a pair of straight, parallelly-disposed, spaced-apart, substantially vertically-oriented, and slender intermediate frame long front upper members 68. Each of the pair of straight, parallelly-disposed, spaced-apart, substantially vertically-oriented, and slender intermediate frame long front upper members 68 of each of the pair of hollow tandemly-positioned and substantially vertically-oriented intermediate frames 26 have an intermediate frame long front upper member lower end 70 and an intermediate frame long front upper member upper end 72.

Each of the pair of straight, parallelly-disposed, spaced-apart, substantially vertically-oriented, and slender intermediate frame long front upper members 68 of each of the pair of hollow tandemly-positioned and substantially vertically-oriented intermediate frames 26, at the intermediate frame front upper member lower end 70 of each of the pair of straight, parallelly-disposed, spaced-apart, substantially vertically-oriented, and slender intermediate frame long front upper members 68 of each of the pair of hollow tandemly-positioned and substantially vertically-oriented intermediate frames 26, extend smoothly upwardly and slightly rearwardly from the intermediate frame short front intermediate member upper end 64 of each of the pair of straight, parallelly-disposed, spaced-apart, substantially vertically-oriented, and slender intermediate frame short front intermediate members 60 of each of the pair of hollow tandemly-positioned and substantially vertically-oriented intermediate frames 26 and form therewith two pair of intermediate frame front intermediate member smooth convexo-concave obtuse bends 74.

The pair of straight, parallelly-disposed, spaced-apart, substantially vertically-oriented, and slender intermediate frame long front upper members 68 of each of the pair of hollow tandemly-positioned and substantially vertically-oriented intermediate frames 26 are disposed forward of the straight, horizontally-oriented, and slender base frame long back member 34 of the hollow horizontally-oriented and substantially opened-front base frame 22, inward of the pair of straight, forwardly-tapering, spaced-apart, horizontally-oriented, and slender base frame short side members 28 of the hollow horizontally-oriented and substantially opened-front base frame 22, and rearward of, and substantially parallel to, the pair of straight, parallelly-disposed, spaced-apart, substantially vertically-oriented, and slender intermediate frame short front lower members 52 of each of the pair of hollow tandemly-positioned and substantially vertically-oriented intermediate frames 26.

Each of the pair of hollow tandemly-positioned and substantially vertically-oriented intermediate frames 26 further include a U-shaped, horizontally oriented, forwardly opening, anal slender intermediate frame top member 76. The U-shaped, horizontally oriented, forwardly opening, and slender intermediate frame top member 76 of each of the pair of hollow tandemly-positioned and substantially vertically-oriented intermediate frames 26 have a pair of intermediate frame top member ends 78 and an intermediate frame top member midpoint 79.

The U-shaped, horizontally oriented, forwardly opening, and slender intermediate frame top member 76 of each of the pair of hollow tandemly-positioned and substantially vertically-oriented intermediate frames 26, at each of the pair of intermediate frame top member ends 78 of the U-shaped, horizontally oriented, forwardly opening, and slender intermediate frame top member 76 of each of the pair of hollow tandemly-positioned and substantially vertically-oriented intermediate frames 26, extend smoothly rearwardly from the intermediate frame long front upper member upper end 72 of each of the pair of straight, parallelly-disposed, spaced-apart, substantially vertically-oriented, and slender intermediate frame long front upper members 68 of each of the pair of hollow tandemly-positioned and substantially vertically-oriented intermediate frames 26 and form therewith two pair of intermediate frame top smooth convexo-concave obtuse bends 80.

The U-shaped, horizontally oriented, forwardly opening, and slender intermediate frame top member 76 of each of the pair of hollow tandemly-positioned and substantially vertically-oriented intermediate frames 26 are disposed forward of the straight, horizontally-oriented, and slender base frame long back member 34 of the hollow horizontally-oriented and substantially opened-front base frame 22, inward of the pair of straight, forwardly-tapering, spaced-apart, horizontally-oriented, and slender base frame short side members 28 of the hollow horizontally-oriented and substantially opened-front base frame 22, and rearward of the pair of straight, parallelly-disposed, spaced-apart, substantially vertically-oriented, and slender intermediate frame short front lower members 52 of each of the pair of hollow tandemly-positioned and substantially vertically-oriented intermediate frames 26.

Each of the pair of hollow tandemly-positioned and substantially vertically-oriented intermediate frames 26 further include a pair of straight, parallelly-disposed, spaced-apart, horizontally-oriented, and slender intermediate frame short back lower members 82. Each of the pair of straight, parallelly-disposed, spaced-apart, horizontally-oriented, and slender intermediate frame short lower back members 82 of each of the pair of hollow tandemly-positioned and substantially vertically-oriented intermediate frames 26 have an intermediate frame short back lower member front end 84 and an intermediate frame short back lower member rear end 86.

Each of the pair of straight, parallelly-disposed, spaced-apart, horizontally-oriented, and slender intermediate frame short back lower members 82 of each of the pair of hollow tandemly-positioned and substantially vertically-oriented intermediate frames 26, at the intermediate frame short back lower member rear end 86 of each of the pair of straight, parallelly-disposed, spaced-apart, horizontally-oriented, and slender intermediate frame short back lower members 82 of each of the pair of hollow tandemly-positioned and substantially vertically-oriented intermediate frames 26, extend abruptly forwardly from each of the two pair of base frame long back member substantially equal-spaced-apart intermediate points 37 of the straight, horizontally-oriented, and slender base frame long back member 34 of the hollow horizontally-oriented and substantially opened-front base frame 22 and is affixed thereto by the suitable fastening means 58.

The pair of straight, parallelly-disposed, spaced-apart, horizontally-oriented, and slender intermediate frame short back lower members 82 of each of the pair of hollow tandemly-positioned and substantially vertically-oriented intermediate frames 26 are disposed inward of the pair of straight, forwardly-tapering, spaced-apart, horizontally-oriented, and slender base frame short side members 28 of the hollow horizontally-oriented and substantially opened-front base frame 22 and rearward of the pair of straight, parallelly-disposed, spaced-apart, substantially vertically-oriented, and slender intermediate frame long front upper members 68 of each of the pair of hollow tandemly-positioned and substantially vertically-oriented intermediate frames 26.

Each of the pair of hollow tandemly-positioned and substantially vertically-oriented intermediate frames 26 further include a pair of straight, slightly inwardly tapering, substantially vertically-oriented, and slender intermediate frame long back intermediate members 88. Each of the pair of straight, slightly inwardly tapering, substantially vertically-oriented, and slender intermediate frame long back intermediate members 88 of each of the pair of hollow tandemly-positioned and substantially vertically-oriented intermediate frames 26 have an intermediate frame long back intermediate member lower end 90 and an intermediate frame long back intermediate member upper end 92.

Each of the pair of straight, slightly inwardly tapering, substantially vertically-oriented, and slender intermediate frame long back intermediate members 88 of each of the pair of hollow tandemly-positioned and substantially vertically-oriented intermediate frames 26, at the intermediate frame long back intermediate member lower end 90 of each of the pair of straight, slightly inwardly tapering, substantially vertically-oriented, and slender intermediate frame long back intermediate members 88 of each of the pair of hollow tandemly-positioned and substantially vertically-oriented intermediate frames 26, extend smoothly upwardly and slightly rearwardly from the intermediate frame short back lower member front end 84 of each of the pair of straight, parallelly-disposed, spaced-apart, horizontally-oriented, slender intermediate frame short back lower members 82 of each of the pair of hollow tandemly-positioned and substantially vertically-oriented intermediate frames 26 and form therewith two pair of intermediate frame back intermediate member smooth convexo-concave acute bends 93.

The pair of straight, slightly inwardly tapering, substantially vertically-oriented, and slender intermediate frame long back intermediate members 88 of each of the pair of hollow tandemly-positioned and substantially vertically-oriented intermediate frames 26 are disposed inward of the pair of straight, forwardly-tapering, spaced-apart, horizontally-oriented, and slender base frame short side members 28 of the hollow horizontally-oriented and substantially opened-front base frame 22, forward of the straight, horizontally-oriented, and slender base frame long back member 34 of the hollow horizontally-oriented and substantially opened-front base frame 22 and rearward of the pair of straight, parallelly-disposed, spaced-apart, substantially vertically-oriented, and slender intermediate frame long front upper members 68 of each of the pair of hollow tandemly-positioned and substantially vertically-oriented intermediate frames 26.

Each of the pair of hollow tandemly-positioned and substantially vertically-oriented intermediate frames 26 further include a semi-circular, substantially vertically-oriented, and slender intermediate frame back upper connecting member 94. The semi-circular, substantially vertically-oriented, and slender intermediate frame back upper connecting member 94 of each of the pair of hollow tandemly-positioned and substantially vertically-oriented intermediate frames 26 have a pair of intermediate frame back upper connecting member ends 96 and an intermediate frame back upper connecting member midpoint 98.

The semi-circular, substantially vertically-oriented, and slender intermediate frame back upper connecting member 94 of each of the pair of hollow tandemly-positioned and substantially vertically-oriented intermediate frames 26, at each of the pair of intermediate frame back upper connecting member ends 96 of the semi-circular, substantially vertically-oriented, and slender intermediate frame back upper connecting member 94 of each of the pair of hollow tandemly-positioned and substantially vertically-oriented intermediate frames 26, extend smoothly upwardly and slightly rearwardly from the intermediate frame long back intermediate member upper end 92 of each of the pair of straight, slightly inwardly tapering, substantially vertically-oriented, and slender intermediate frame long back intermediate members 88 of each of the pair of hollow tandemly-positioned and substantially vertically-oriented intermediate frames 26 and form therewith two pair of intermediate frame back upper member smooth convexo-concave smooth bends 100.

The intermediate frame back upper connecting member midpoint 98 of the semi-circular, substantially vertically-oriented, and slender intermediate frame back upper connecting member 94 of each of the pair of hollow tandemly-positioned and substantially vertically-oriented intermediate frames 26 are affixed to the intermediate frame top member midpoint 79 of the U-shaped, horizontally oriented, forwardly opening, and slender intermediate frame top member 76 of each of the pair of hollow tandemly-positioned and substantially vertically-oriented intermediate frames 26 by the suitable fastening means 58.

The semi-circular, substantially vertically-oriented, and slender intermediate frame back upper connecting member 94 of each of the pair of hollow tandemly-positioned and substantially vertically-oriented intermediate frames 26 are disposed inward of the pair of straight, forwardly-tapering, spaced-apart, horizontally-oriented, and slender base frame short side members 28 of the hollow horizontally-oriented and substantially opened-front base frame 22, forward of the straight, horizontally-oriented, and slender base frame long back member 34 of the hollow horizontally-oriented and substantially opened-front base frame 22 and rearward of the pair of straight, parallelly-disposed, spaced-apart, substantially vertically-oriented, and slender intermediate frame long front upper members 68 of each of the pair of hollow tandemly-positioned and substantially vertically-oriented intermediate frames 26.

Each of the pair hollow substantially vertically-oriented side frames 24 include a straight, substantially vertically-oriented, and slender side frame long back member 102. The straight, substantially vertically-oriented, and slender side frame long back member 102 of each of the pair hollow substantially vertically-oriented side frames 24 have a side frame long back member lower end 104, a side frame long back member upper end 106 and a side frame back member intermediate point 107.

The straight, substantially vertically-oriented, and slender side frame long back member 102 of each of the pair hollow substantially vertically-oriented side frames 24, at the side frame long back member lower end 104 of the straight, substantially vertically-oriented, and slender side frame long back member 102 of each of the pair hollow substantially vertically-oriented side frames 24, extend abruptly upwardly and slightly rearwardly from the base frame short side member back end 32 of each of the pair of straight, forwardly-tapering, spaced-apart, horizontally-oriented, and slender base frame short side members 28 of the hollow horizontally-oriented and substantially opened-front base frame 22.

The straight, substantially vertically-oriented, and slender side frame long back member 102 of each of the pair hollow substantially vertically-oriented side frames 24 are disposed forward of the straight, horizontally-oriented, and slender base frame long back member 34 of the hollow horizontally-oriented and substantially opened-front base frame 22, and rearward of the pair of straight, slightly inwardly tapering, substantially vertically-oriented, and slender intermediate frame long back intermediate members 88 of each of the pair of hollow tandemly-positioned and substantially vertically-oriented intermediate frames 26 and have a length that is greater than the height of the pair of hollow tandemly-positioned and substantially vertically-oriented intermediate frames 26.

Each of the pair hollow substantially vertically-oriented side frames 24 further include a straight, substantially horizontally-oriented, and slender side frame short top member 108. The straight, substantially horizontally-oriented, and slender side frame short top member 108 of each of the pair of hollow substantially vertically-oriented side frames 24 have a side frame short top member rear end 110, and a side frame short top member front end 112.

The straight, substantially horizontally-oriented, and slender side frame short top member 108 of each of the pair hollow substantially vertically-oriented side frames 24, at the side frame short top member rear end 110 of the straight, substantially horizontally-oriented, and slender side frame short top member 108 of each of the pair hollow substantially vertically-oriented side frames 24, extend smoothly forwardly and slightly upwardly from the side frame long back member upper end 106 of the straight, substantially vertically-oriented, and slender side frame long back member 102 of each of the pair hollow substantially vertically-oriented side frames 24 and form therewith a pair of side frame back member smooth convexo-concave normal bends 114.

The straight, substantially horizontally-oriented, and slender side frame short top member 108 of each of the pair hollow substantially vertically-oriented side frames 24 are disposed upward of the pair hollow substantially vertically-oriented side frames 24.

Each of the pair hollow substantially vertically-oriented side frames 24 further include a straight, substantially vertically-oriented, and slender side frame short front member 116. The straight, substantially vertically-oriented, and slender side frame short front member 116 of each of the pair of hollow substantially vertically-oriented side frames 24 have a side frame short front member upper end 118, and a side frame short front member lower end 120.

The straight, substantially vertically-oriented, and slender side frame short front member 116 of each of the pair hollow substantially vertically-oriented side frames 24, at the side frame short front member upper end 118 of the straight, substantially vertically-oriented, and slender side frame short front member 116 of each of the pair hollow substantially vertically-oriented side frames 24, extend smoothly downwardly and slightly forwardly from the side frame short top member front end 112 of the straight, substantially horizontally-oriented, and. slender side frame short top member 108 of each of the pair hollow substantially vertically-oriented side frames 24 and form therewith a pair of side frame top member smooth convexo-concave normal bends 122.

The straight, substantially vertically-oriented, and slender side frame short front member 116 of each of the pair hollow substantially vertically-oriented side frames 24 are disposed forward of, and substantially parallel to, the straight, substantially vertically-oriented, and slender side frame long back member 102 of each of the pair hollow substantially vertically-oriented side frames 24.

Each of the pair hollow substantially vertically-oriented side frames 24 further include a straight, substantially horizontally-oriented, and slender side frame short intermediate member 124. The straight, substantially horizontally-oriented, and slender side frame short intermediate member 124 of each of the pair of hollow substantially vertically-oriented side frames 24 have a side frame short intermediate member front end 126, and a side frame short intermediate member rear end 128.

The straight, substantially horizontally-oriented, and slender side frame short intermediate member 124 of each of the pair hollow substantially vertically-oriented side frames 24, at the side frame short intermediate member front end 126 of the straight, substantially horizontally-oriented, and slender side frame short intermediate member 124 of each of the pair hollow substantially vertically-oriented side frames 24, extend smoothly rearwardly and slightly downwardly from the side frame short front member lower end 120 of the straight, substantially horizontally-oriented, and slender side frame short front member 116 of each of the pair hollow substantially vertically-oriented side frames 24 and form therewith a pair of side frame front member smooth convexo-concave normal bends 130.

The straight, substantially horizontally-oriented, and slender side frame short intermediate member 124 of each of the pair hollow substantially vertically-oriented side frames 24, at the side frame short intermediate member rear end 128 of the straight, substantially horizontally-oriented, and slender side frame short intermediate member 124 of each of the pair hollow substantially vertically-oriented side frames 24, extend abruptly forwardly and slightly upwardly from the side frame back member intermediate point 107 of the straight, substantially vertically-oriented, and slender side frame long back member 102 of each of the pair hollow substantially vertically-oriented side frames 24 and are affixed thereto by the suitable fastening means 58.

The straight, substantially horizontally-oriented, and slender side frame short intermediate member 124 of each of the pair hollow substantially vertically-oriented side frames 24 are disposed below, and substantially parallel to, and have substantially the same length as, the straight, substantially horizontally-oriented, and slender side frame short top member 108 of each of the pair of hollow substantially vertically-oriented side frames 24, and are disposed upward of the pair of hollow substantially vertically-oriented side frames 24.

The part of the straight, substantially vertically-oriented, and slender side frame long back member 102 of each of the pair hollow substantially vertically-oriented side frames 24 intermediate the side frame long back member upper end 106 of the straight, substantially vertically-oriented, and slender side frame long back member 102 of each of the pair hollow substantially vertically-oriented side frames 24 and the side frame back member intermediate point 107 of the straight, substantially vertically-oriented, and slender side frame long back member 102 of each of the pair hollow substantially vertically-oriented side frames 24 together with the straight, substantially horizontally-oriented, and slender side frame short. top member 108 of each of the pair hollow substantially vertically-oriented side frames 24 and together with the straight, substantially vertically-oriented, and slender side frame short front member 116 of each of the pair hollow substantially vertically-oriented side frames 24 and together with the straight, substantially horizontally-oriented, and slender side frame short intermediate member 124 form a pair of hand grips 132.

Each of the pair hollow substantially vertically-oriented side frames 24 further include a straight, substantially vertically-oriented, and slender side frame long reinforcement member 134. The straight, substantially vertically-oriented, and slender side frame long reinforcement member 134 of each of the pair of hollow substantially vertically-oriented side frames 24 have a side frame long reinforcement member upper end 136, and a side frame long reinforcement member lower end 138.

The straight, substantially vertically-oriented, and slender side frame long reinforcement member 134 of each of the pair hollow substantially vertically-oriented side frames 24, at the side frame long reinforcement member lower end 138 of the straight, substantially vertically-oriented, and slender side frame long reinforcement member 134 of each of the pair hollow substantially vertically-oriented side frames 24, extend abruptly upwardly and slightly rearwardly from the base frame short side member intermediate point 33 of each of the pair of straight, forwardly-tapering, spaced-apart, horizontally-oriented, and slender base frame short side members 28 of the hollow horizontally-oriented and substantially opened-front base frame 22 and are affixed thereto by the suitable fastening means 58.

The straight, substantially vertically-oriented, and slender side frame long reinforcement member 134 of each of the pair hollow substantially vertically-oriented side frames 24, at the side frame long reinforcement member upper end 136 of the straight, substantially vertically-oriented, and slender side frame long reinforcement member 134 of each of the pair hollow substantially vertically-oriented side frames 24, extend abruptly downwardly and slightly forwardly from the side frame back member intermediate point 107 of the straight, substantially vertically-oriented, and slender side frame long back member 102 of each of the pair hollow substantially vertically-oriented side frames 24 and are affixed thereto by the suitable fastening means 58.

The operation of the multiple sock donning assist device 10 can best be seen in FIGS. 1 and 2, and as such, will be discussed with reference thereto.

Figure 2:
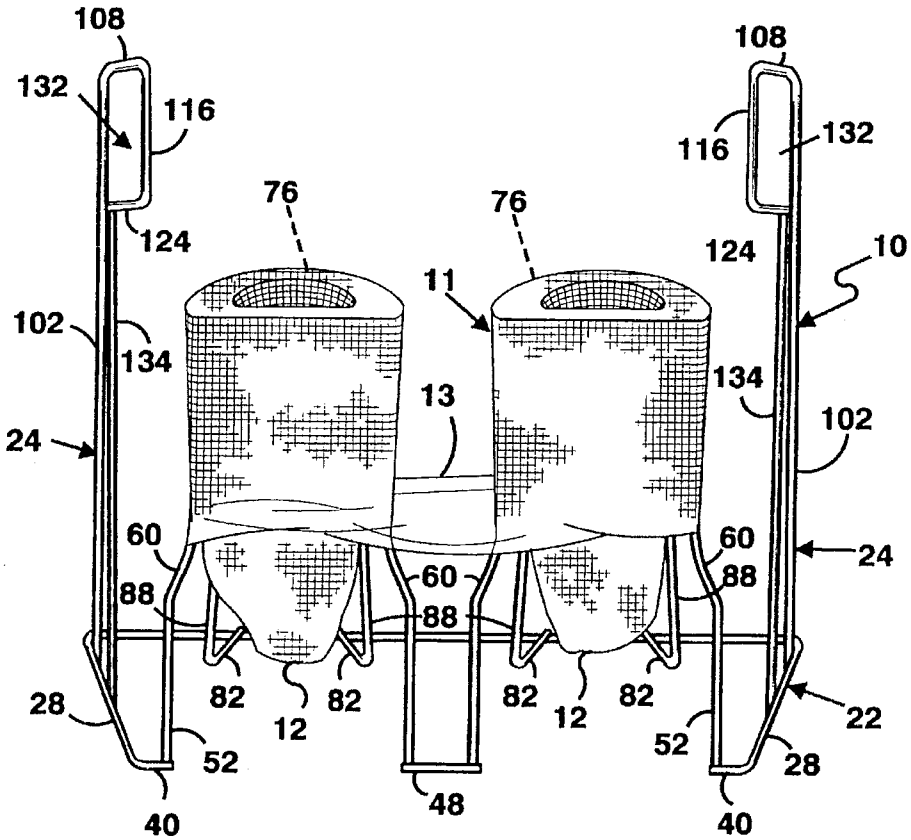
FIG. 2 is a diagrammatic perspective view illustrating the present invention with the pantyhose installed thereon.
Figure 3:
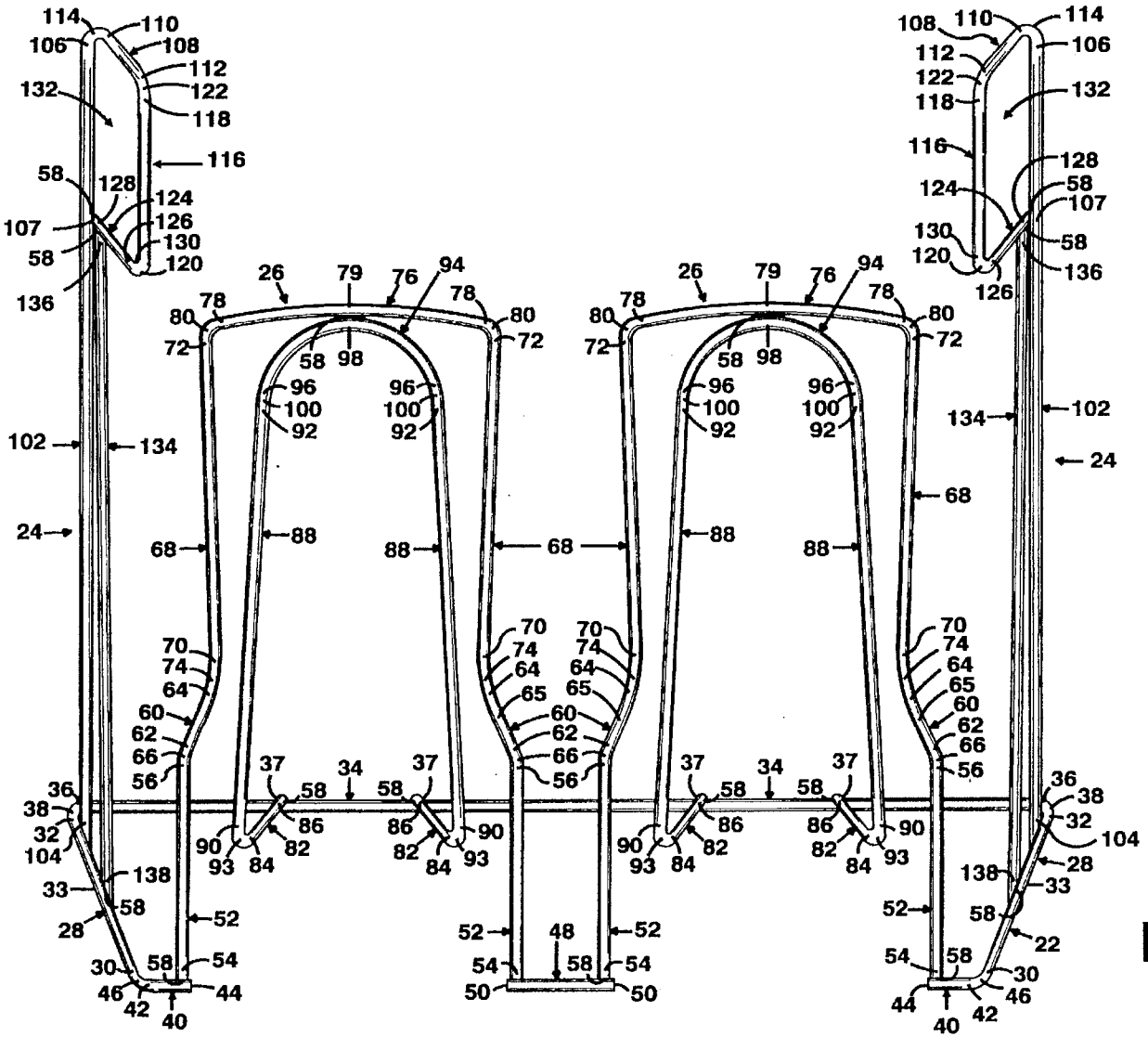
FIG. 3 is a diagrammatic front perspective view of the present: invention.

As shown in FIG. 2, each of the pantyhose lower portions 12 of the pantyhose 11 are placed through the U-shaped, horizontally oriented, forwardly opening, and slender intermediate frame top member 76 of each of the pair of hollow tandemly-positioned and substantially vertically-oriented intermediate frames 26 with each of the pantyhose lower portions 12 of the pantyhose 11 positioned in the interior space of each of the pair of hollow tandemly-positioned and substantially vertically-oriented intermediate frames 26.

The pantyhose upper portion 13 of the pantyhose 11 is stretched over the U-shaped, horizontally oriented, forwardly opening, and slender intermediate frame top member 76 of each of the pair of hollow tandemly-positioned and substantially vertically-oriented intermediate frames 26.

The pantyhose upper portion 13 of the pantyhose 11 is then pulled down over the exterior of each of the pair of hollow tandemly-positioned and substantially vertically-oriented intermediate frames 26 so as to be compressingly secured thereto.

As shown in FIG. 1, the pair of user hands 20 of the user 18 are wrapped around the straight, substantially horizontally-oriented, and slender side frame short top member 108 of each of the pair of hollow substantially vertically-oriented side frames 24 in a securely gripping fashion.

It is to be understood that the pair of user hands 20 of the user 18 can also be wrapped simultaneously around the straight, substantially horizontally-oriented, and slender side frame short top member 108 of each of the pair of hollow substantially vertically-oriented side frames 24 and the straight, substantially horizontally-oriented, and slender side frame short intermediate member 124 of each of the pair of hollow substantially vertically-oriented side frames 24 to increase gripping ability when the donning assist device 10 is being used.

The user legs 16 of the user 18 are inserted into the pantyhose lower portions 12 of the pantyhose 11.

The combination of the multiple sock donning assist device 10 and the pantyhose 11 are gently pulled upwardly on the user legs 16 of the user 18.

The pantyhose upper portion 13 of the pantyhose 11 pulls up and off the exterior of the pair of hollow tandemly-positioned and substantially vertically-oriented intermediate frames 26, as the combination of the multiple sock donning assist device 10 and the pantyhose 11 is gently pulled upwardly on the user legs 16 of the user 18, and becomes compressingly secured to the user 18.

The multiple sock donning assist device 10 is then removed with the user legs 16 of the user 18, leaving the U-shaped, horizontally oriented, forwardly opening, and slender intermediate frame top member 76 of each of the pair of hollow tandemly-positioned and substantially vertically-oriented intermediate frames 26.

It will be understood that each of the elements described above, or two or more together, may also find a useful application in other types of constructions differing from the types described above.

While the invention has been illustrated and described as embodied in a multiple sock donning assist device, it is not limited to the details shown, since it will be understood that various omissions, modifications, substitutions and changes in the forms and details of the device illustrated and its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute characteristics of the generic or specific aspects of this invention.

The invention claimed is:

1. A multiple leg covering donning assist device, comprising:

a) a hollow horizontally-oriented and substantially opened-front base frame with ends; said hollow horizontally-oriented and substantially opened-front base frame includes a pair of straightlly forwardly-tapering, spaced-apart, horizontally-oriented, and slender short side members; each of said pair of straight, forwardly-tapering, spaced-apart, horizontally-oriented, and slender short side members of said hollow horizontally-oriented and substantially opened-front base frame has a front end, a back end, and an intermediate point; said hollow horizontally-oriented and substantially opened-front base frame further includes a straight, horizontally-oriented, and slender long back member that has a pair of ends, and two pair of substantially equally-spaced-apart intermediate points; said straight, horizontally-oriented, and slender long back member of said hollow horizontally-oriented and substantially opened-front base frame, at each of said pair of ends of said straight, horizontally-oriented, and slender long back member of said hollow horizontally-oriented and substantially opened-front base frame, extends smoothly from said back end of each of said pair of straight, forwardly-tapering, spaced-apart, horizontally-oriented, and slender short side members of said hollow horizontally-oriented and substantially opened-front base frame and forms therewith a pair of smooth convexo-concave acute bends; said straight, horizontally-oriented, and slender long back member of said hollow horizontally-oriented and substantially opened-front base frame and said pair of straight, forwardly-tapering, spaced-apart, horizontally-oriented, and slender short side members of said hollow horizontally-oriented and substantially opened-front base frame lie in the same horizontal plane; said hollow horizontally-oriented and substantially opened-front base frame further includes a pair of straight, horizontally-oriented, and slender front short outer members; each of said pair of straight, horizontally-oriented, and slender front short outer members of said hollow horizontally-oriented and substantially opened-front base frame has a proximal end, and a distal end; each of said pair of straight, horizontally-oriented, and slender front short outer members of said hollow horizontally-oriented and substantially opened-front base frame, at said proximal end of each of said pair of straight, horizontally-oriented, and slender front short outer members of said hollow horizontally-oriented and substantially opened-front base frame, extends smoothly inwardly from said front end of each of said pair of straight, forwardly-tapering, spaced-apart, horizontally-oriented, and slender short side members of said hollow horizontally-oriented and substantially opened-front base frame and form therewith a pair of smooth convexo-concave obtuse bends; said pair of straight, horizontally-oriented, and slender front short outer members of said hollow horizontally-oriented and substantially opened-front base frame lie in the same horizontal plane as, are parallel to, and are disposed in front of, said straight, horizontally-oriented, and slender long back member of said hollow horizontally-oriented and substantially opened-front base frame;

b) a pair of hollow substantially vertically-oriented side frames for gripping by a user and extending vertically upwardly and slightly rearwardly from the ends of said hollow horizontally-oriented and substantially opened-front base frame and having a height; and c) a pair of hollow tandemly-positioned and substantially vertically-oriented intermediate frames for receiving leg coverings and extending vertically upwardly and slightly rearwardly from said hollow horizontally-oriented and substantially opened-front base frame and being disposed intermediate said pair of hollow substantially vertically-oriented side frames, so that both legs of a user can be covered simultaneously.

2. The device as defined in claim 1, wherein said hollow horizontally-oriented and substantially opened-front base frame further includes a straight, horizontally-oriented, and slender front short intermediate member; said straight, horizontally-oriented, and slender front short intermediate member of said hollow horizontally-oriented and substantially opened-front base frame has a pair of ends; said straight, horizontally-oriented, and slender front short intermediate member of said hollow horizontally-oriented and substantially opened-front base frame is disposed intermediate of, spaced from, and collinear with said pair of straight, horizontally-oriented, and slender front short outer members of said hollow horizontally-oriented and substantially opened-front base frame.

3. The device as defined in claim 2, wherein each of said pair of hollow tandemly-positioned and substantially vertically-oriented intermediate frames include a pair of straight, parallelly-disposed, spaced-apart, substantially vertically-oriented, and slender short front lower members; each of said pair of straight, parallelly-disposed, spaced-apart, substantially vertically-oriented, and slender short front lower members of each of said pair of hollow tandemly-positioned and substantially vertically-oriented intermediate frames have a lower end, and an upper end; each of said pair of straight, parallelly-disposed, spaced-apart, substantially vertically-oriented, and slender short front lower members of each of said pair of hollow tandemly-positioned and substantially vertically-oriented intermediate frames, at said lower end of each of said pair of straight, parallelly-disposed, spaced-apart, substantially vertically-oriented, and slender short front lower members of each of said pair of hollow tandemly-positioned and substantially vertically-oriented intermediate frames, extend abruptly upwardly and slightly rearwardly from said distal end of each of said pair of straight, horizontally-oriented, and slender front short outer members of said hollow horizontally-oriented and substantially opened-front base frame and extend abruptly upwardly and slightly rearwardly from each of said pair of ends of said straight, horizontally-oriented, and slender front short intermediate member of said hollow horizontally-oriented and substantially opened-front base frame, respectively, and are affixed thereto by suitable fastening means; said pair of straight, parallelly-disposed, spaced-apart, substantially vertically-oriented, and slender short front lower members of each of said pair of hollow tandemly-positioned and substantially vertically-oriented intermediate frames are disposed forward of said straight, horizontally-oriented, and slender long back member of said hollow horizontally-oriented and substantially opened-front base frame and between said pair of straight, forwardly-tapering, spaced-apart, horizontally-oriented, and slender short side members of said hollow horizontally-oriented and substantially opened-front base frame.

4. The device as defined in claim 3, wherein each of said pair of hollow tandemly-positioned and substantially vertically-oriented intermediate frames further include a pair of straight, parallelly-disposed, spaced-apart, substantially vertically-oriented, and slender short front intermediate members; each of said pair of straight, parallelly-disposed, spaced-apart, substantially vertically-oriented, and slender short front intermediate members of each of said pair of hollow tandemly-positioned and substantially vertically-oriented intermediate frames have a lower end and an upper end; each of said pair of straight, parallelly-disposed, spaced-apart, substantially vertically-oriented, and slender short front intermediate members of each of said pair of hollow tandemly-positioned and substantially vertically-oriented intermediate frames, at the lower end of each of said pair of straight, parallelly-disposed, spaced-apart, substantially vertically-oriented, and slender short front intermediate members of each of said pair of hollow tandemly-positioned and substantially vertically-oriented intermediate frames, extend smoothly upwardly and rearwardly from said upper end of each of said pair of straight, parallelly-disposed, spaced-apart, substantially vertically-oriented, and slender short front lower members of each of said pair of hollow tandemly-positioned and substantially vertically-oriented intermediate frames and form therewith two pair of smooth convexo-concave obtuse bends; said pair of straight, parallelly-disposed, spaced-apart, substantially vertically-oriented, and slender short front intermediate members of each of said pair of hollow tandemly-positioned and substantially vertically-oriented intermediate frames are disposed in front of said straight, horizontally-oriented, and slender long back member of said hollow horizontally-oriented and substantially opened-front base frame and between said pair of straight, forwardly-tapering, spaced-apart, horizontally-oriented, and slender short side members of said hollow horizontally-oriented and substantially opened-front base frame.

5. The device as defined in claim 4, wherein each of said pair of hollow tandemly-positioned and substantially vertically-oriented intermediate frames further include a pair of straight, parallelly-disposed, spaced-apart, substantially vertically-oriented, and slender long front upper members; each of said pair of straight, parallelly-disposed, spaced-apart, substantially vertically-oriented, and slender long front upper members of each of said pair of hollow tandemly-positioned and substantially vertically-oriented intermediate frames have a lower end and an upper end; each of said pair of straight, parallelly-disposed, spaced-apart, substantially vertically-oriented, and slender long front upper members of each of said pair of hollow tandemly-positioned and substantially vertically-oriented intermediate frames, at the lower end of each of said pair of straight, parallelly-disposed, spaced-apart, substantially vertically-oriented, and slender long front upper members of each of said pair of hollow tandemly-positioned and substantially vertically-oriented intermediate frames, extend smoothly upwardly and slightly rearwardly from the upper end of each of said pair of straight, parallelly-disposed, spaced-apart, substantially vertically-oriented, and slender short front intermediate members of each of said pair of hollow tandemly-positioned and substantially vertically-oriented intermediate frames and form therewith two pair of smooth convexo-concave obtuse bends; said pair of straight, parallelly-disposed, spaced-apart, substantially vertically-oriented, and slender long front upper members of each of said pair of hollow tandemly-positioned and substantially vertically-oriented intermediate frames are disposed in front of said straight, horizontally-oriented, and slender long back member of said hollow horizontally-oriented and substantially opened-front base frame, between said pair of straight, forwardly-tapering, spaced-apart, horizontally-oriented, and slender short side members of said hollow horizontally-oriented and substantially opened-front base frame, and behind of, and substantially parallel to, said pair of straight, parallelly-disposed, spaced-apart, substantially vertically-oriented, and slender short front lower members of each of said pair of hollow tandemly-positioned and substantially vertically-oriented intermediate frames.

6. The device as defined in claim 5, wherein each of said pair of hollow tandemly-positioned and substantially vertically-oriented intermediate frames further include a U-shaped, horizontally oriented, forwardly opening, and slender top member; said U-shaped, horizontally oriented, forwardly opening, and slender top member of each of said pair of hollow tandemly-positioned and substantially vertically-oriented intermediate frames have a pair of ends, and a midpoint; said U-shaped, horizontally oriented, forwardly opening, and slender top member of each of said pair of hollow tandemly-positioned and substantially vertically-oriented intermediate frames, at each of said pair of ends of said U-shaped, horizontally oriented, forwardly opening, and slender top member of each of said pair of hollow tandemly-positioned and substantially vertically-oriented intermediate frames, extend smoothly rearwardly from said upper end of each of said pair of straight, parallelly-disposed, spaced-apart, substantially vertically-oriented, and slender long front upper members of each of said pair of hollow tandemly-positioned and substantially vertically-oriented intermediate frames and form therewith two pair of smooth convexo-concave obtuse bends; said U-shaped, horizontally oriented, forwardly opening, and slender top member of each of said pair of hollow tandemly-positioned and substantially vertically-oriented intermediate frames are disposed in front of said straight, horizontally-oriented, and slender long back member of said hollow horizontally-oriented and substantially opened-front base frame, between said pair of straight, forwardly-tapering, spaced-apart, horizontally-oriented, and slender short side members of said hollow horizontally-oriented and substantially opened-front base frame, and behind said pair of straight, parallelly-disposed, spaced-apart, substantially vertically-oriented, and slender short front lower members of each of said pair of hollow tandemly-positioned and substantially vertically-oriented intermediate frames.

7. The device as defined in claim 6, wherein each of said pair of hollow tandemly-positioned and substantially vertically-oriented intermediate frames further include a pair of straight, parallelly-disposed, spaced-apart, horizontally-oriented, and slender short back lower members; each of said pair of straight, parallelly-disposed, spaced-apart, horizontally-oriented, and slender short lower back members of each of said pair of hollow tandemly-positioned and substantially vertically-oriented intermediate frames have a front and a rear end; each of said pair of straight, parallelly-disposed, spaced-apart, horizontally-oriented, and slender short back lower members of each of said pair of hollow tandemly-positioned and substantially vertically-oriented intermediate frames, at said rear end of each of said pair of straight, parallelly-disposed, spaced-apart, horizontally-oriented, and slender short back lower members of each of said pair of hollow tandemly-positioned and substantially vertically-oriented intermediate frames, extend abruptly forwardly from each of said two pair of substantially equal-spaced-apart intermediate points of said straight, horizontally-oriented, and slender long back member of said hollow horizontally-oriented and substantially opened-front base frame and is affixed thereto by said suitable fastening means; said pair of straight, parallelly-disposed, spaced-apart, horizontally-oriented, and slender short back lower members of each of said pair of hollow tandemly-positioned and substantially vertically-oriented intermediate frames are disposed between said pair of straight, forwardly-tapering, spaced-apart, horizontally-oriented, and slender short side members of said hollow horizontally-oriented and substantially opened-front base frame and behind said pair of straight, parallelly-disposed, spaced-apart, substantially vertically-oriented, and slender long front upper members of each of said pair of hollow tandemly-positioned and substantially vertically-oriented intermediate frames.

8. The device as defined in claim 7, wherein each of said pair of hollow tandemly-positioned and substantially vertically-oriented intermediate frames further include a pair of straight, slightly inwardly tapering, substantially vertically-oriented, and slender long back intermediate members; each of said pair of straight, slightly inwardly tapering, substantially vertically-oriented, and slender long back intermediate members of each of said pair of hollow tandemly-positioned and substantially vertically-oriented intermediate frames have a lower end and an upper end; each of said pair of straight, slightly inwardly tapering, substantially vertically-oriented, and slender long back intermediate members of each of said pair of hollow tandemly-positioned and substantially vertically-oriented intermediate frames, at said lower end of each of said pair of straight, slightly inwardly tapering, substantially vertically-oriented, and slender long back intermediate members of each of said pair of hollow tandemly-positioned and substantially vertically-oriented intermediate frames, extend smoothly upwardly and slightly rearwardly from the front end of each of said pair of straight, parallelly-disposed, spaced-apart, horizontally-oriented, slender short back lower members of each of said pair of hollow tandemly-positioned and substantially vertically-oriented intermediate frames and form therewith two pair of smooth convexo-concave acute bends; said pair of straight, slightly inwardly tapering, substantially vertically-oriented, and slender long back members of each of said pair of hollow tandemly-positioned and substantially vertically-oriented intermediate frames are disposed between said pair of straight, forwardly-tapering, spaced-apart, horizontally-oriented, and slender short side members of said hollow horizontally-oriented and substantially opened-front base frame, in front of said straight, horizontally-oriented, and slender long back member of said hollow horizontally-oriented and substantially opened-front base frame, and behind said pair of straight, parallelly-disposed, spaced-apart, substantially vertically-oriented, and slender long front upper members of each of said pair of hollow tandemly-positioned and substantially vertically-oriented intermediate frames.

9. The device as defined in claim 8, wherein each of said pair of hollow tandemly-positioned and substantially vertically-oriented intermediate frames further include a semi-circular, substantially vertically-oriented, and slender back upper connecting member; said semi-circular, substantially vertically-oriented, and slender back upper connecting member of each of said pair of hollow tandemly-positioned and substantially vertically-oriented intermediate frames have a pair of ends, and a midpoint; said semi-circular, substantially vertically-oriented, and slender back upper connecting member of each of said pair of hollow tandemly-positioned and substantially vertically-oriented intermediate frames, at each of said pair of ends of said semi-circular, substantially vertically-oriented, and slender back upper connecting member of each of said pair of hollow tandemly-positioned and substantially vertically-oriented intermediate frames, extend smoothly upwardly and slightly rearwardly from said upper end of each of said pair of straight, slightly inwardly tapering, substantially vertically-oriented, and slender long back intermediate members of each of said pair of hollow tandemly-positioned and substantially vertically-oriented intermediate frames and form therewith two pair of smooth convexo-concave smooth bends; said midpoint of the semi-circular, substantially vertically-oriented, and slender back upper connecting member of each of said pair of hollow tandemly-positioned and substantially vertically-oriented intermediate frames are affixed to said midpoint of the U-shaped, horizontally oriented, forwardly opening, and slender top member of each of said pair of hollow tandemly-positioned and substantially vertically-oriented intermediate frames by said suitable fastening means; said semi-circular, substantially vertically-oriented, and slender back upper connecting member of each of said pair of hollow tandemly-positioned and substantially vertically-oriented intermediate frames are disposed between said pair of straight, forwardly-tapering, spaced-apart, horizontally-oriented, and slender short side members of said hollow horizontally-oriented and substantially opened-front base frame, in front of said straight, horizontally-oriented, and slender long back member of said hollow horizontally-oriented and substantially opened-front base frame, and behind said pair of straight, parallelly-disposed, spaced-apart, substantially vertically-oriented, and slender long front upper members of each of said pair of hollow tandemly-positioned and substantially vertically-oriented intermediate frames.

10. The device as defined in claim 9, wherein each of said pair hollow substantially vertically-oriented side frames include a straight, substantially vertically-oriented, and slender long back member; said straight, substantially vertically-oriented, and slender long back member of each of said pair hollow substantially vertically-oriented side frames have a lower end, an upper end, a length, and an intermediate point; said straight, substantially vertically-oriented, and slender long back member of each of said pair hollow substantially vertically-oriented side frames, at said lower end of said straight, substantially vertically-oriented, and slender long back member of each of said pair hollow substantially vertically-oriented side frames, extend abruptly upwardly and slightly rearwardly from said back end of each of said pair of straight, forwardly-tapering, spaced-apart, horizontally-oriented, and slender short side members of said hollow horizontally-oriented and substantially opened-front base frame; said straight, substantially vertically-oriented, and slender long back member of each of said pair hollow substantially vertically-oriented side frames are disposed in front of said straight, horizontally-oriented, and slender long back member of said hollow horizontally-oriented and substantially opened-front base frame, and behind said pair of straight, slightly inwardly tapering, substantially vertically-oriented, and slender long back intermediate members of each of said pair of hollow tandemly-positioned and substantially vertically-oriented intermediate frames; said length of said straight, substantially vertically-oriented, and slender long back member of each of said pair hollow substantially vertically-oriented side frames is greater than said height of said pair of hollow tandemly-positioned and substantially vertically-oriented intermediate frames.

11. The device as defined in claim 10, wherein each of said pair hollow substantially vertically-oriented side frames further include a straight, substantially horizontally-oriented, and slender short top member; said straight, substantially horizontally-oriented, and slender short top member of each of said pair of hollow substantially vertically-oriented side frames have a rear end, and a front end; said straight, substantially horizontally-oriented, and slender short top member of each of said pair hollow substantially vertically-oriented side frames, at said rear end of said straight, substantially horizontally-oriented, and slender short top member of each of said pair hollow substantially vertically-oriented side frames, extend smoothly forwardly and slightly upwardly from said upper end of said straight, substantially vertically-oriented, and slender long back member of each of said pair hollow substantially vertically-oriented side frames and form therewith a pair of smooth convexo-concave normal bends; said straight, substantially horizontally-oriented, and slender short top member of each of said pair hollow substantially vertically-oriented side frames are disposed above said pair hollow substantially vertically-oriented side frames.

12. The device as defined in claim 11, wherein each of said pair hollow substantially vertically-oriented side frames further include a straight, substantially vertically-oriented, and slender short front member; said straight, substantially vertically-oriented, and slender short front member of each of said pair of hollow substantially vertically-oriented side frames have an upper end, and a lower end; said straight, substantially vertically-oriented, and slender short front member of each of said pair hollow substantially vertically-oriented side frames, at said upper end of said straight, substantially vertically-oriented, and slender short front member of each of said pair hollow substantially vertically-oriented side frames, extend smoothly downwardly and slightly forwardly from said front end of said straight, substantially horizontally-oriented, and slender short top member of each of said pair hollow substantially vertically-oriented side frames and form therewith a pair of smooth convexo-concave normal bends; said straight, substantially vertically-oriented, and slender short front member of each of said pair hollow substantially vertically-oriented side frames are disposed in front of, and substantially parallel to, said straight, substantially vertically-oriented, and slender long back member of each of said pair hollow substantially vertically-oriented side frames.

13. The device as defined in claim 12, wherein each of said pair hollow substantially vertically-oriented side frames further include a straight, substantially horizontally-oriented, and slender short intermediate member; said straight, substantially horizontally-oriented, and slender short intermediate member of each of said pair of hollow substantially vertically-oriented side frames have a front end, and a rear end; said straight, substantially horizontally-oriented, and slender short intermediate member of each of said pair hollow substantially vertically-oriented side frames, at said front end of said straight, substantially horizontally-oriented, and slender short intermediate member of each of said pair hollow substantially vertically-oriented side frames, extend smoothly rearwardly and slightly downwardly from said lower end of said straight, substantially horizontally-oriented, and slender short front member of each of said pair hollow substantially vertically-oriented side frames and form therewith a pair of smooth convexo-concave normal bends; said straight, substantially horizontally-oriented, and slender short intermediate member of each of said pair hollow substantially vertically-oriented side frames, at said rear end of said straight, substantially horizontally-oriented, and slender short intermediate member of each of said pair hollow substantially vertically-oriented side frames, extend abruptly forwardly and slightly upwardly from said intermediate point of said straight, substantially vertically-oriented, and slender long back member of each of said pair hollow substantially vertically-oriented side frames and are affixed thereto by said suitable fastening means; said straight, substantially horizontally-oriented, and slender short intermediate member of each of said pair of hollow substantially vertically-oriented side frames are disposed below, and substantially parallel to, and have substantially the same length as, said straight, substantially horizontally-oriented, and slender short top member of each of said pair of hollow substantially vertically-oriented side frames, and are disposed above said pair of hollow substantially vertically-oriented side frames.

14. The device as defined in claim 13, wherein said straight, substantially horizontally-oriented, and slender short top member of each of said pair hollow substantially vertically-oriented side frames, together with said straight, substantially vertically-oriented, and slender short front member of each of said pair hollow substantially vertically-oriented side frames, together with said straight, substantially horizontally-oriented, and slender short intermediate member of each of said pair hollow substantially vertically-oriented side frames, and together with the part of said straight, substantially vertically-oriented, and slender long back member of each of said pair hollow substantially vertically-oriented side frames that is intermediate said upper end of said straight, substantially vertically-oriented, and slender long back member of each of said pair hollow substantially vertically-oriented side frames and said intermediate point of said straight, substantially vertically-oriented, and slender long back member of each of said pair hollow substantially vertically-oriented side frames form a pair of hand grips.

15. The device as defined in claim 14, wherein each of said pair hollow substantially vertically-oriented side frames further include a straight, substantially vertically-oriented, and slender long reinforcement member; said straight, substantially vertically-oriented, and slender long reinforcement member of each of said pair of hollow substantially vertically-oriented side frames have an upper end, and a lower end; said straight, substantially vertically-oriented, and slender long reinforcement member of each of said pair hollow substantially vertically-oriented side frames, at said lower end of said straight, substantially vertically-oriented, and slender long reinforcement member of each of said pair hollow substantially vertically-oriented side frames, extend abruptly upwardly and slightly rearwardly from said intermediate point of each of said pair of straight, forwardly-tapering, spaced-apart, horizontally-oriented, and slender short side members of said hollow horizontally-oriented and substantially opened-front base frame and are affixed thereto by said suitable fastening means; said straight, substantially vertically-oriented, and slender long reinforcement member of each of said pair hollow substantially vertically-oriented side frames, at said upper end of said straight, substantially vertically-oriented, and slender long reinforcement member of each of said pair hollow substantially vertically-oriented side frames, extend abruptly downwardly and slightly forwardly from said intermediate point of said straight, substantially vertically-oriented, and slender long back member of each of said pair hollow substantially vertically-oriented side frames and are affixed thereto by said suitable fastening means.

16. A method for using a multiple leg covering donning assist device, said device comprising a pair of hollow tandemly-positioned and substantially vertically-oriented. intermediate frames each of which having a U-shaped, horizontally oriented, forwardly opening, and slender top member, an interior space, and an exterior, said device further comprising a pair of hollow substantially vertically-oriented side frames each of which having a straight, substantially horizontally-oriented, and slender short top member, comprising the steps of:

a) placing a lower portion of a leg covering through said U-shaped, horizontally oriented, forwarding opening, and slender top member of each of said pair of hollow tandemly-positioned and substantially vertically-oriented intermediate frames with the lower portion of the leg covering positioned in said interior space of each of said pair of hollow tandemly-positioned and substantially vertically-oriented intermediate frames;

b) stretching an upper portion of the leg covering over said U-shaped, horizontally oriented, forwardly opening, and slender top member of each of said pair of hollow tandemly-positioned and substantially vertically-oriented intermediate frames;

c) pulling down the upper portion of the leg covering over said exterior of each of said pair of hollow tandemly-positioned and substantially vertically-oriented intermediate frames so as to be compressingly secured thereto;

d) wrapping the pair of hands of a user around said straight, substantially horizontally-oriented, and slender short top member of each of said pair of hollow substantially vertically-oriented side frames in a securely gripping fashion;

e) inserting the legs of the user into the lower portion of the leg covering;

f) pulling gently upward said combination of said multiple sock donning assist device and the leg covering on the legs of the user;

g) pulling the upper portion of the leg covering up and off said exterior of said pair of hollow tandemly-positioned and substantially vertically-oriented intermediate frames, as said multiple sock donning assist device and the leg covering are gently pulled upwardly on the legs of the user, and becoming compressingly secured to the user; and h) removing said multiple sock donning assist device with the legs of the user, leaving said U-shaped, horizontally oriented, forwardly opening, and slender top member of each of said pair of hollow tandemly-positioned and substantially vertically-oriented intermediate frames, so that both legs are covered simultaneously.

* * * * *